US009310754B2

(12) United States Patent
Takano

(10) Patent No.: US 9,310,754 B2
(45) Date of Patent: Apr. 12, 2016

(54) RETRACTOR AND IMAGE FORMING APPARATUS INCORPORATING THE RETRACTOR

(71) Applicant: Kuniyori Takano, Kanagawa (JP)

(72) Inventor: Kuniyori Takano, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/798,606

(22) Filed: Jul. 14, 2015

(65) Prior Publication Data

US 2016/0018779 A1 Jan. 21, 2016

(30) Foreign Application Priority Data

Jul. 15, 2014 (JP) ..... 2014-144924

(51) Int. Cl.
*G03G 15/00* (2006.01)
*G03G 21/16* (2006.01)

(52) U.S. Cl.
CPC ..... *G03G 21/1609* (2013.01)

(58) Field of Classification Search
CPC ..... G03G 21/1609; B41J 2/385; B41J 2/41; B41J 2/435; B41J 2/45
USPC ..... 399/4; 347/119, 138, 152
See application file for complete search history.

(56) References Cited

U.S. PATENT DOCUMENTS

| | | | | |
|---|---|---|---|---|
| 5,339,132 | A * | 8/1994 | Tomita | B41J 2/45 399/4 |
| 8,760,483 | B2 * | 6/2014 | Masuda | B41J 2/451 347/138 |
| 2010/0232092 | A1 * | 9/2010 | Sakamoto | B41J 2/45 |
| 2012/0155916 | A1 | 6/2012 | Ito et al. | |
| 2013/0308983 | A1 | 11/2013 | Takano | |
| 2014/0147166 | A1 | 5/2014 | Nakamura et al. | |

FOREIGN PATENT DOCUMENTS

| | | |
|---|---|---|
| JP | 2011-221563 | 11/2011 |
| JP | 2014-002350 | 1/2014 |

* cited by examiner

*Primary Examiner* — Susan Lee
(74) *Attorney, Agent, or Firm* — Harness, Dickey & Pierce, P.L.C.

(57) ABSTRACT

A retractor that is applicable to an image forming apparatus includes a moving unit to move a latent image forming device between an image forming position and a retracted position, a first guide into which a first projection of the latent image forming device is fitted in different ranges and changing an attitude of the one end side of the latent image forming device, and a second guide into which a second projection of the latent image forming device is fitted in different ranges and changing the attitude of the opposed end side of the latent image forming device. The different ranges include a first range and a second range. An amount of play in at least a part of the first range with respect to the corresponding projection is greater than an amount of play in the second range.

9 Claims, 13 Drawing Sheets

RETRACTOR AND IMAGE FORMING APPARATUS INCORPORATING THE RETRACTOR

CROSS-REFERENCE TO RELATED APPLICATIONS

This patent application is based on and claims priority pursuant to 35 U.S.C. §119(a) to Japanese Patent Application No. 2014-144924, filed on Jul. 15, 2014, in the Japan Patent Office, the entire disclosure of which is hereby incorporated by reference herein.

BACKGROUND

1. Technical Field

This disclosure relates to a retractor to retract an exposure device from an image forming position to a retracted position and an image forming apparatus incorporating the retractor.

2. Related Art

It is widely known that, in order to form an electrostatic latent image on a surface of the photoconductor that functions as a latent image bearer, image forming apparatuses include an exposure device, for example, having multiple light emitting elements in an axial direction of a photoconductor provided therein.

The exposure device of the image forming apparatus is designed to move between an image forming position at which an electrostatic latent image is formed on the surface of the photoconductor and a retracted position at which the exposure device stays out of the way when replacing the photoconductor and a developing device also included in the image forming apparatus.

As a first link unit pivots around a rotational support, a second link unit pivots in a counterclockwise direction around the rotational support via a connecting unit. Then, a support projection and a guide projection of the exposure device move upwardly away from a photoconductor drum along a guide slot and the exposure device moves from the image forming position toward the retracted position along the normal direction of the photoconductor drum. As the support projection moves along a curved part of the guide slot, the exposure device pivots, and thereof the position thereof changes. After the guide projection passes the curved part of the guide slot, the exposure device changes to a retracted attitude before reaching the retracted position.

SUMMARY

At least one aspect of this disclosure provides a retractor including a moving unit, a first guide, and a second guide. The moving unit moves a latent image forming device that forms a latent image on a surface of a latent image bearer between an image forming position at which the latent image forming device forms the latent image on the surface of the latent image bearer and a retracted position at which the latent image forming device stays away from the latent image forming device. The first guide is a guide into which a first projection provided on one end side of the latent image forming device in a longitudinal direction of the latent image forming device is fitted in different ranges. The first guide changes an attitude of the one end side of the latent image forming device while guiding the first projection. The second guide is a guide into which a second projection provided on an opposed end side of the latent image forming device in the longitudinal direction of the latent image forming device is fitted in different ranges and changing the attitude of the opposed end side of the latent image forming device while guiding the second projection. The different ranges of each of the first guide and the second guide includes a first range where the attitude of each of the one end side and the opposed end side of the latent image forming device is changed and a second range where a corresponding one of the first projection and the second projection is located when the latent image forming device is at the image forming position. An amount of play in at least a part of the first range with respect to the corresponding one of the first projection and the second projection is greater than an amount of play in the second range.

Further, at least one aspect of this disclosure provides an image forming apparatus including a latent image bearer, a latent image forming device to form a latent image on a surface of the latent image bearer, and the above-described retractor.

DETAILED DESCRIPTION

Figure 1:
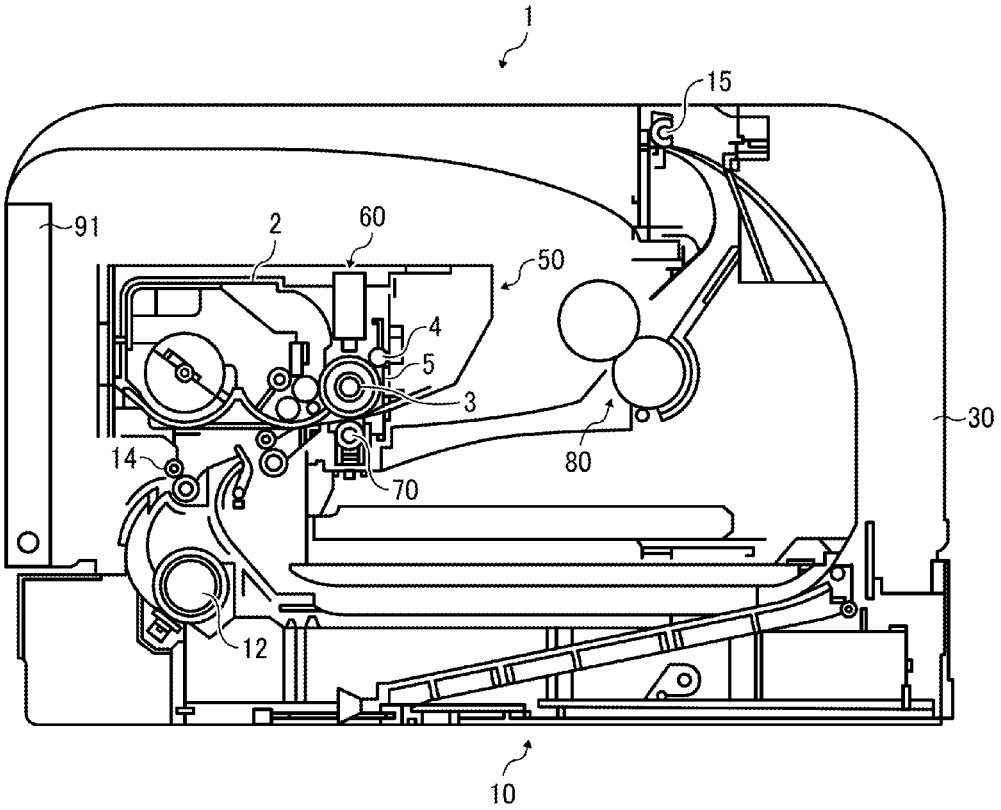
FIG. 1 is a diagram illustrating an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 1 according to an example of this disclosure.

FIG. 1 is a diagram illustrating an image forming apparatus 1 according to an example of this disclosure.

Descriptions are given of an example applicable to a retractor and an image forming apparatus incorporating the retractor with reference to the following figures. It is to be noted that identical parts are given identical reference numerals and redundant descriptions are summarized or omitted accordingly.

The image forming apparatus 1 may be a copier, a printer, a scanner, a facsimile machine, a plotter, and a multifunction peripheral or a multifunction primer (MFP) having at least one of copying, printing, scanning, facsimile, and plotter functions, or the like. According to the present example, the image forming apparatus 1 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that: the term "image forming apparatus" indicates an apparatus in which an image is formed on a recording medium such as paper, OHP (overhead projector) transparencies, OHP film sheets, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

As illustrated in FIG. 1, the image forming apparatus 1 includes a process cartridge 50, an exposure device 60, a transfer unit, a sheet tray 10, and a fixing device 80 in an apparatus body 30 thereof. The transfer unit includes a transfer roller 70. The process cartridge 50 is detachably attachable to the apparatus body 30 of the image forming apparatus 1. The exposure device 60 functions as a latent image forming device.

The process cartridge 50 includes a photoconductor drum 3 that functions as a latent image bearer, a charging roller 4 that functions as a charger, a developing device 2, and a cleaning device 5 that functions as a cleaner.

The photoconductor drum 3 rotates in the counterclockwise direction in FIG. 1.

The charging roller 4 uniformly charges a surface of the photoconductor drum 3 while the photoconductor drum 3 is rotating.

The exposure device 60 emits laser light to irradiate the surface of the photoconductor drum 3 so as to form an electrostatic latent image on the surface thereof based on image data of the image.

The developing device 2 develops the electrostatic latent image formed on the photoconductor drum 3 into a visible toner image.

The transfer unit transfers the toner image with the transfer roller 70 onto a sheet that functions as a recording medium. The sheet is fed from the sheet tray 10 by a feed roller 12 and conveyed by a registration roller pair 14.

After the toner image has been transferred onto the sheet, the fixing device 80 fixes the toner image to the sheet. The sheet is discharged by a sheet ejection roller 15 to an outside of the image forming apparatus 1.

The cleaning device 5 removes residual toner remaining on the surface of the photoconductor drum 3. Further, an electrical discharge lamp that functions as an electrical discharger removes residual electrical charge from the surface of the photoconductor drum 3.

In a case in which the process cartridge 50 is replaced due to mechanical aging changes of the photoconductor drum 3 and the developing device 2, a user opens a cover 91 provided on a left side face of the apparatus body 30 illustrated in FIG. 1 and removes the process cartridge 50 from the left side face of the apparatus body 30.

It is to be noted that the process cartridge 50 according to the present example supports the photoconductor drum 3 and the developing device 2 integrally. However, the photoconductor drum 3 and the developing device 2 may be provided separately and detachably attachable to the apparatus body 30.

Figure 2B:
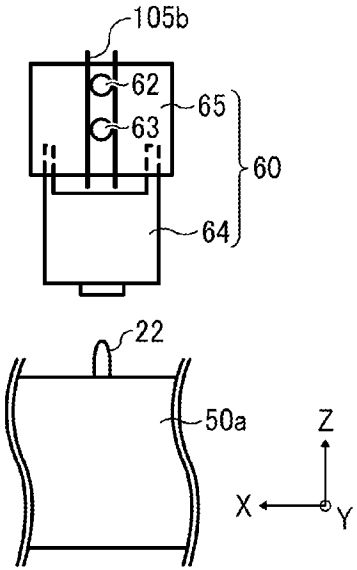
FIG. 2B is a side view of the exposure device of FIG. 2A.
Figure 2A:
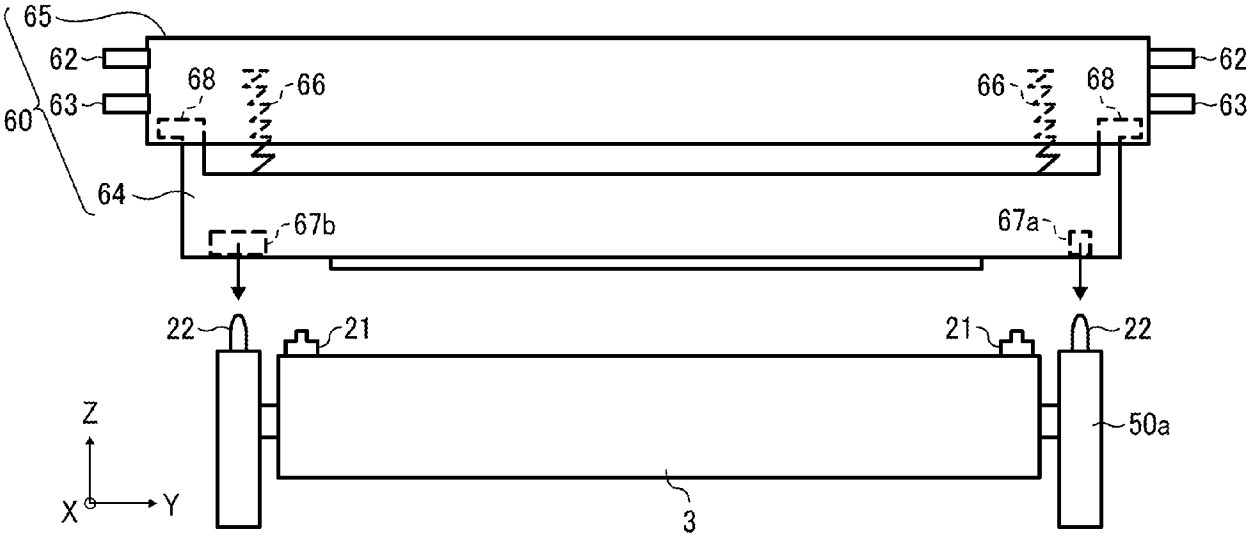
FIG. 2A is a front view illustrating a schematic configuration of an exposure device and adjacent components incorporated in the image forming apparatus of FIG. 1.

FIG. 2A is a front view illustrating a schematic configuration of the exposure device 60 and adjacent components incorporated in the image forming apparatus 1 of FIG. 1. FIG. 2B is a side view of the exposure device 60 of FIG. 2A.

As illustrated in FIGS. 2A and 2B, the exposure device 60 includes a writing head 64 and a holder 65.

The writing head 64 that functions as a writing unit includes multiple light emitting elements such as light emitting diodes (LEDs) and/or organic electroluminescence (EL) elements arranged in a longitudinal direction of the photoconductor drum 3 and multiple lenses arranged on the photoconductor drum 3 and the multiple light emitting elements. The writing head 64 is biased to the photoconductor drum 3 by springs 66 and is supported by the holder 65. The writing head 64 causes a light emitting element to emit light based on image data so as to irradiate the photoconductor drum 3 via the lens or lenses. By so doing, the photoconductor drum 3 is exposed to form an electrostatic latent image on a surface of the photoconductor drum 3.

The holder 65 supports the writing head 64. A support projection 62 and a guide projection 63 are vertically disposed at each longitudinal end of the holder 65. The support projection 62 and the guide projection 63 are supported by a retracting unit which is described below.

Spacers 21 are disposed between the photoconductor drum 3 and the writing head 64. Each of the spacers 21 functions as a regulator to regulate a distance between the photoconductor drum 3 and the writing head 64. The spacers 21 are provided facing the writing head 64 in a non-image forming area of the photoconductor drum 3 and slidable with respect to the photoconductor drum 3.

Positioning bosses 22 are provided at both axial ends of a case 50*a* of the process cartridge 50. A round positioning hole 67*a* is disposed at one axial end (a right end in FIG. 2A) of the writing head 64 as a primary reference for positioning for positioning the writing head 64 of the exposure device 60. A rectangular positioning hole 67*b* is disposed at an opposed axial end (a left end in FIG. 2A) of the writing head 64 as a sub or secondary reference for positioning the writing head 64 of the exposure device 60.

Figure 3B:
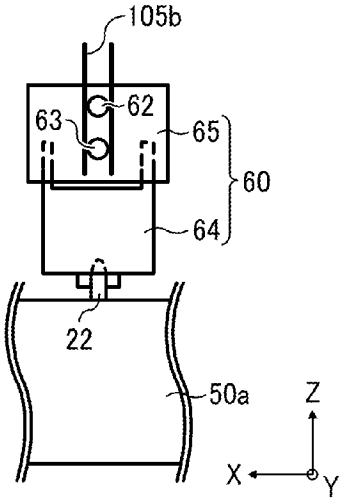
FIG. 3B is a side view of the exposure device of FIG. 3A.
Figure 3A:
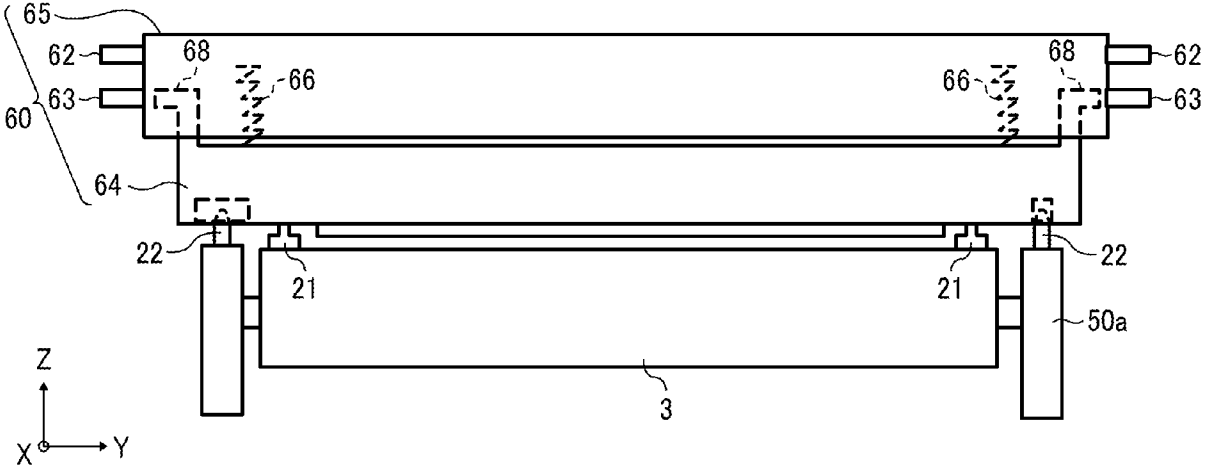
FIG. 3A is a front view illustrating a state in which the exposure device is positioned.

FIG. 3A is a front view illustrating a state in which the exposure device 60 is positioned. FIG. 3B is a side view of the exposure device 60 of FIG. 3A.

As illustrated in FIGS. 3A and 3B, the respective positioning bosses 22 are fitted to the positioning holes 67*a* and 67*b* of the writing head 64, so that the writing head 64 is positioned in a Y-orientation (i.e., an axial direction and a main scanning direction) and an X-orientation (i.e., a sub-scanning direction) in FIG. 3A. Further, the writing head 64 contacts the spacers 21, so that the writing head 64 is positioned in a Z-orientation (i.e., a normal direction of the photoconductor drum 3) in FIG. 3A.

The exposure device 60 is moved by a retracting device 20 (described below) from a retracted position to an image forming position. Even after the writing head 64 has contacted one or both of the spacers 21, the holder 65 is moved by the retracting device 20 toward the photoconductor drum 3. Consequently, the springs 66 are compressed and respective movement regulating parts 68 of the writing head 64 separate from the holder 65. As a result, the writing head 64 is pressed to the spacers 21 by respective biasing forces generated by the springs 66.

In order to fit the respective positioning bosses 22 to the positioning holes 67*a* and 67*b* of the writing head 64 reliably, a width of an exposure device guide slot 105*b* (see FIGS. 2B and 3B) near the image forming position is substantially identical to a diameter of the guide projection 63 and a width of the support projection 62. At the image forming position, the holder 65 is positioned by the exposure device guide slot 105*b*. By positioning the holder 65 of the exposure device 60 to the exposure device guide slot 105*b*, the holder 65 of the exposure device 60 is prevented from rattling due to vibration caused when forming an electrostatic latent image, and therefore noise in the electrostatic latent image due to the vibration of the holder 65 is prevented. The writing head 64 and the holder 65 have given gutters in the X-orientation and the Y-orientation so that the writing head 64 can be smoothly positioned by the positioning bosses 22 in the X-orientation and the Y-orientation.

Since a focal length of the writing head 64 is short, the exposure device 60 is disposed close to the photoconductor drum 3. This configuration hinders detachment and attachment of the process cartridge 50 with respect to the apparatus body 30.

In order to address this inconvenience, the retracting device 20 is provided to the image forming apparatus 1 so that the exposure device 60 according to an example of this disclosure can move between an image forming position at which the exposure device 60 is located close to the photoconductor drum 3 and a retracted position at which the exposure device 60 is located spaced away from the photoconductor drum 3.

Now, a detailed description is given of the retracting device 20 according to an example of this disclosure.

Figure 4:
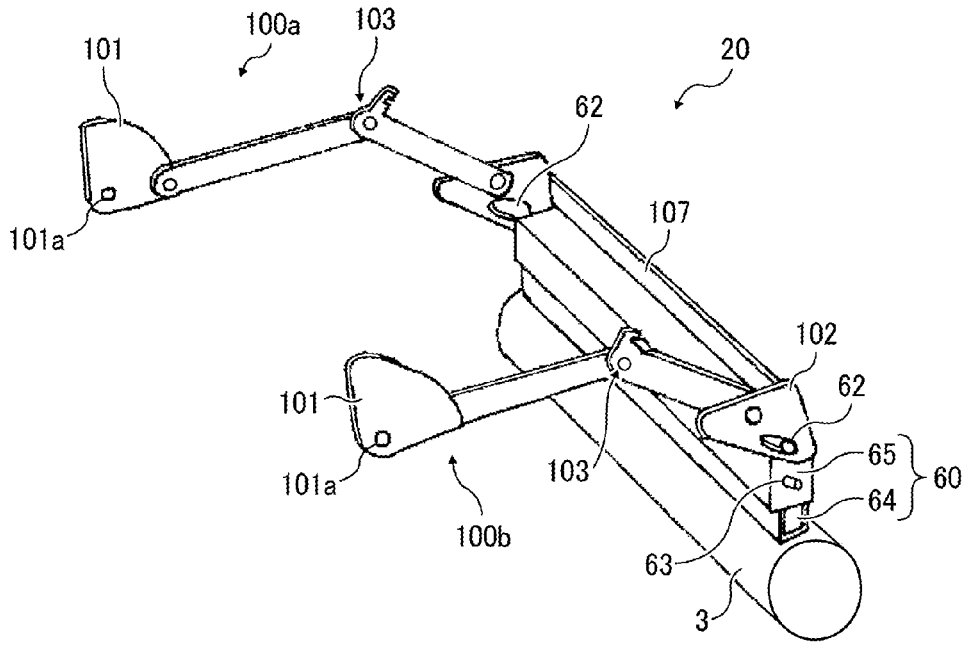
FIG. 4 is a perspective view illustrating a retracting device, the exposure device, and a photoconductor drum.

FIG. 4 is a perspective view illustrating the refracting device 20, the exposure device 60, and the photoconductor drum 3.

As illustrated in FIG. 4, the retracting device 20 includes respective retracting units 100*a* and 100*b* at both longitudinal ends of the exposure device 60. Since the retracting units 100*a* and 100*b* have identical configurations and functions to each other, the retracting units 100*a* and 100*b* are hereinafter referred to in a singular form as the "retracting unit 100" occasionally.

Figure 5:
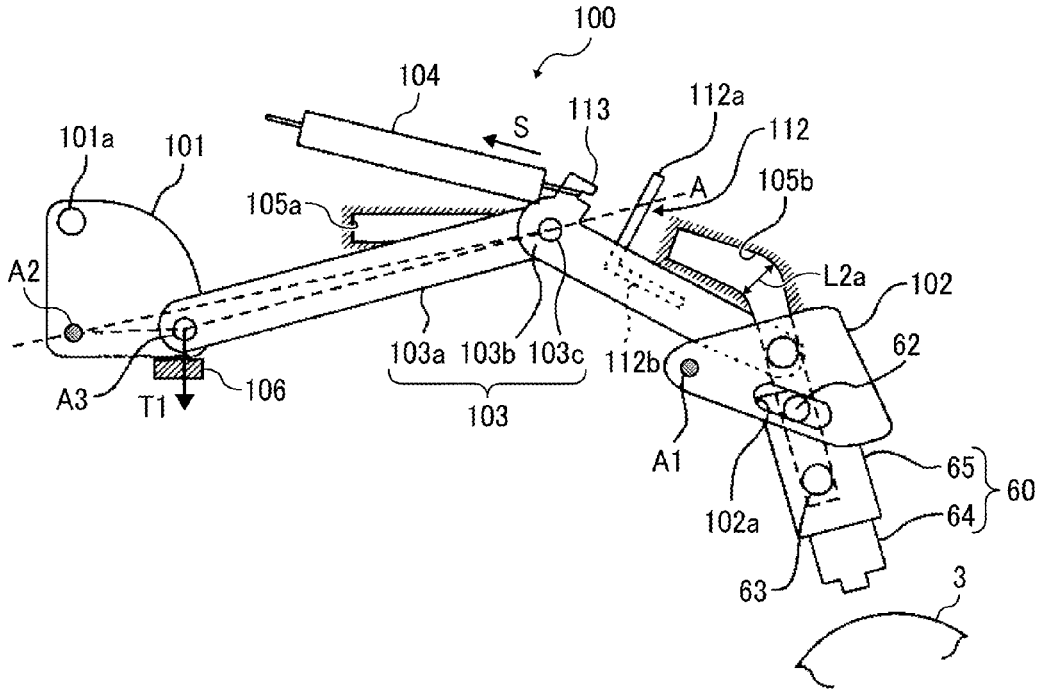
FIG. 5 is a diagram illustrating a schematic configuration of a retracting unit provided to the retracting device of FIG. 4.

FIG. 5 is a diagram illustrating a schematic configuration of the retracting unit 100 provided to the retracting device 20 of FIG. 4. Specifically, in FIG. 5, the exposure device 60 is located at the image forming position where an electrostatic latent image is formed on the surface of the photoconductor drum 3.

As illustrated in FIG. 5, the retracting unit 100 that functions as a moving unit includes a first link unit 101, a second link unit 102, and a connecting unit 103. The first link unit 101 is rotatably supported by the apparatus body 30 of the image forming apparatus 1. The second link unit 102 that functions as a holder to hold the exposure device 60. The second link unit 102 is rotatably supported by the apparatus body 30 of the image forming apparatus 1. The connecting unit 103 functions as a connector to connect the first link unit 101 and the second link unit 102.

The connecting unit 103 includes a first connecting member 103*a* and a second connecting member 103*b*. One end of the first connecting member 103*a* is rotatably supported by the first link unit 101 and an opposed end of the first connecting member 103*a* is rotatably supported by a connecting shaft 103*c*. One end of the second connecting member 103*b* is rotatably supported by the connecting shaft 103*c* and an opposed end of the second connecting member 103*b* is rotatably supported by the second link unit 102. The connecting shaft 103*c* passes through a connection guide hole 105*a* of a cover unit 105 (see FIG. 6). The connection guide hole 105*a* extends toward a cover 91 (see FIG. 9), which is toward the left side in FIG. 5.

The second link unit 102 has a support slot 102*a* that is an elongated hole extending toward a rotational support A1 of the second link unit 102. A support projection 62, which is provided on both ends in a longitudinal direction of the holder 65 of the exposure device 60, passes through the support slot 102*a*. By causing the support projection 62 of the holder 65 of the exposure device 60 to pass through the support slot 102*a*, the exposure device 60 is supported by the retracting unit 100. As illustrated in FIG. 5, the support projection 62 also passes through the exposure device guide slot 105*b* that functions as a guide provided to the cover unit 105 (sec FIG. 6). Further, the holder 65 of the exposure device 60 includes the guide projection 63 that passes through the exposure device guide slot 105*b*. The exposure device guide slot 105*b* has a width L1*a*, as illustrated in FIG. 5. The width L1*a* is greater than a width of the other parts of the exposure device guide slot 105*b*. Detailed descriptions of the widths of the exposure device guide slot 105*b* including the width L1*a* are described below.

The first link unit 101 is a fan-shaped unit having a central angle of approximately 90 degrees. A first connecting member 103*a* is rotatably supported at one end in a circumferential direction of the first link unit 101. A boss section 101*a* that functions as a first contact part is disposed at an opposed end in the circumferential direction of the first link unit 101.

A hook 113 is disposed at one end side of the second connecting member 103*b*, at which the second connecting member 103*b* is rotatably supported by the connecting shaft 103*c*. The hook 113 functions as a biasing member to hook one end of a tension spring 104. By so doing, the tension spring 104 biases the second connecting member 103*b* to a direction indicated by arrow S illustrated in FIG. 5.

Due to a biasing force generated by the tension spring 104, the connecting shaft 103*c* receives a force to move to the first link unit 101. At this time, a support position A3 of the first connecting member 103*a* is located below a line segment A connecting a rotational support A2 about which the first link unit 101 turns and the connecting shaft 103*c* in FIG. 5. Consequently, a force applied to move the connecting shaft 103*c* to the first link unit 101 generates a force to move to the support position A3 in a direction indicated by arrow T1 in FIG. 5. As a result, the first link unit 101 contacts against a regulating member 106 that functions as a regulator provided to the apparatus body 30.

As described above, in the present example, the first link unit 101 is biased in a clockwise direction in FIG. 5 via the connecting unit 103 by the tension spring 104 that functions as a biasing member. In this state, the first link unit 101 contacts the regulating member 106, so as to move the exposure device 60 to position at the image forming position.

Further, in the present example, the respective retracting units 100 (i.e.. the retracting units 100*a* and 100*b*) are provided at both ends of the exposure device 60, as illustrated in FIG. 4. Providing the retracting units 100 at both ends of the exposure device 60 can prevent deviation of time in movements of both ends of the exposure device 60.

Further, a single retracting unit 100 may be disposed at either of the one end side and the opposed end side of the exposure device 60. In this case, the deviation of time in movements of the one end side and the opposed end side of the exposure device 60 is increased, however, the image forming apparatus 1 can achieve a reduction in cost of the image forming apparatus 1.

Further, as illustrated in FIG. 4, one end side of the retracting unit 100*a* and an opposed end side of the retracting unit 100*b* are connected by a retracting unit connecting member 107. Specifically, the retracting unit connecting member 107 connects the second link unit 102 of the retracting unit 100 (i.e., the retracting unit 100*a*) at the one end side of the exposure device 60 and the second link unit 102 of the retracting unit 100 (i.e., the retracting unit 100*b*) at the opposed end side of the exposure device 60. By so doing, the retracting unit 100*a* at the one end side of the exposure device 60 and the retracting unit 100*b* at the opposed end side of the exposure device 60 move together with each other, and therefore occurrence of deviation of time between movement of the retracting unit 100*a* and the retracting unit 100*b* can be prevented.

When the process cartridge 50 is attached to or inserted into the apparatus body 30 of the image forming apparatus 1, the process cartridge 50 is likely to contact or hit the exposure device 60 at the retracted position and damage or break the exposure device 60. Further, it is likely that a user touches the exposure device 60 by inserting the hand through an opening area of the cover 91 when the cover 91 is left open.

In order to address the above-described inconvenience, a protection member 112 is provided to protect the exposure device 60 at the retracted position. The protection member 112 extends in the longitudinal direction of the exposure device 60. Both one end and an opposed end of the protection member 112 are secured to a side plate provided at one end of the apparatus body 30. As illustrated in FIG. 5, the protection member 112 includes a first face 112*a* and a second face 112*b* that extends in a direction perpendicular to the first face 112*a*. In other words, the first face 112*a* and the second face 112*b* form a substantially L-shape in cross section. The first face

112*a* is disposed facing a face of the exposure device 60 on the side of the cover 91 when the exposure device 60 is located at the retracted position. The second face 112*b* is disposed such that a detaching area of the process cartridge 50 and the exposure device 60 located at the retracted position are partitioned.

Figure 6:
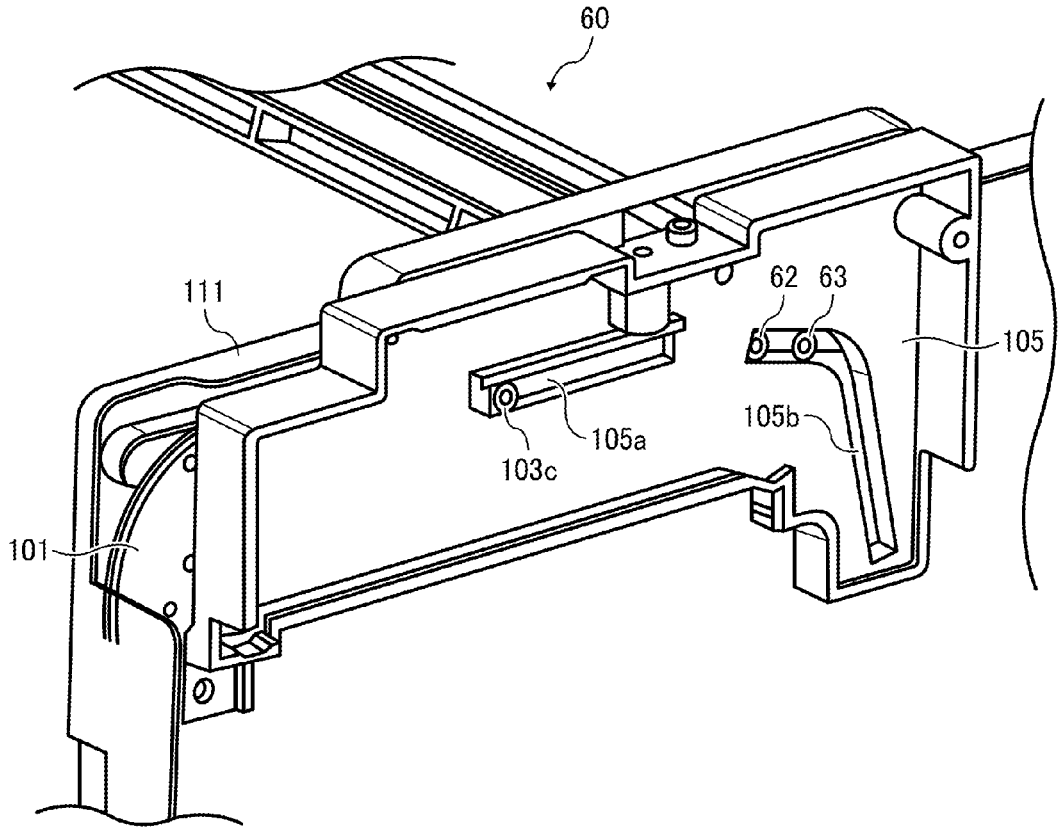
FIG. 6 is a perspective view illustrating a cover.

Further, as illustrated in FIG. 6, an apparatus body side plate 111 and the cover unit 105 cover the first link unit 101, the first connecting member 103*a*, and the second connecting member 103*b*. Consequently, this configuration can prevent a user from touching the first link unit 101, the first connecting member 103*a*, and the second connecting member 103*b* when the cover 91 is opened. Therefore, the configuration can prevent the user from moving the exposure device 60 from the retracted position to the image forming position. Accordingly, the exposure device 60 is located at the image forming position when the process cartridge 50 is attached, which can prevent exposure device 60 from contacting or hitting the process cartridge 50.

Further, the cover unit 105 is provided with the connection guide hole 105*a* that guides the connecting shaft 103*c* and the exposure device guide slot 105*b* that guides the support projection 62 and the guide projection 63.

Next, a description is given of movement of the exposure device 60 between the image forming position and the retracted position with reference to FIGS. 7 through 11.

Figure 7:
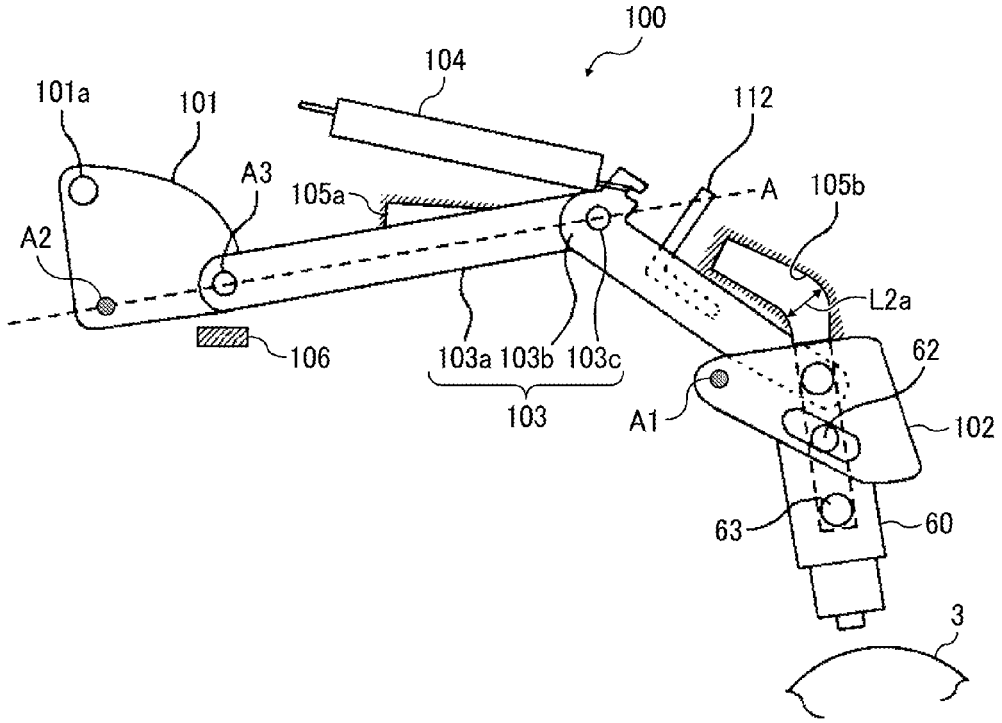
FIG. 7 is a diagram illustrating the retracting unit in a state in which the exposure device is moving from an image forming position to a retracted position.
Figure 8:
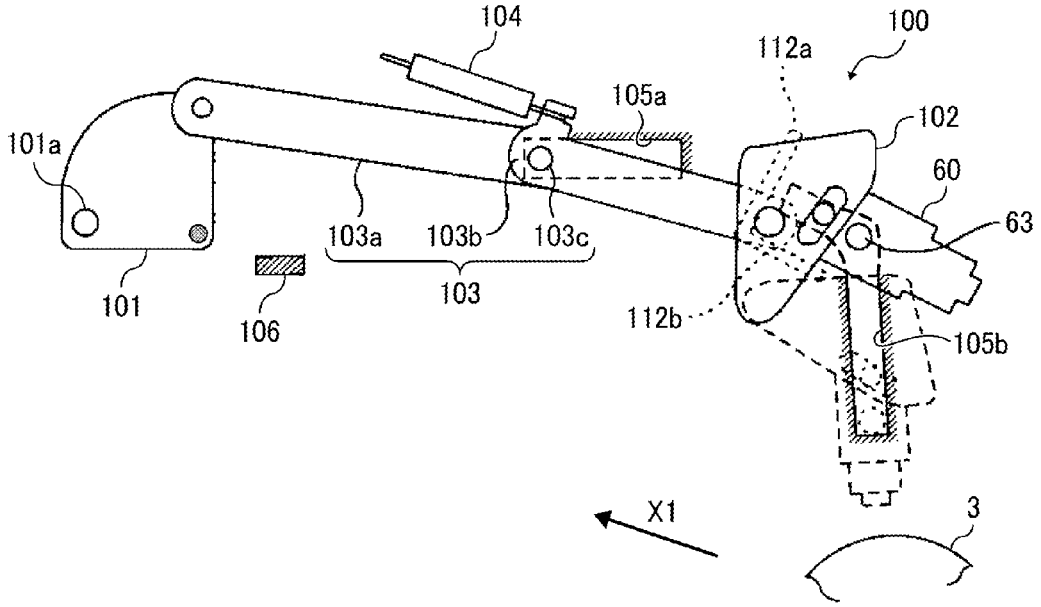
FIG. 8 is a diagram illustrating the retracting unit in a state in which the exposure device is located at the retracted position.
Figure 9:
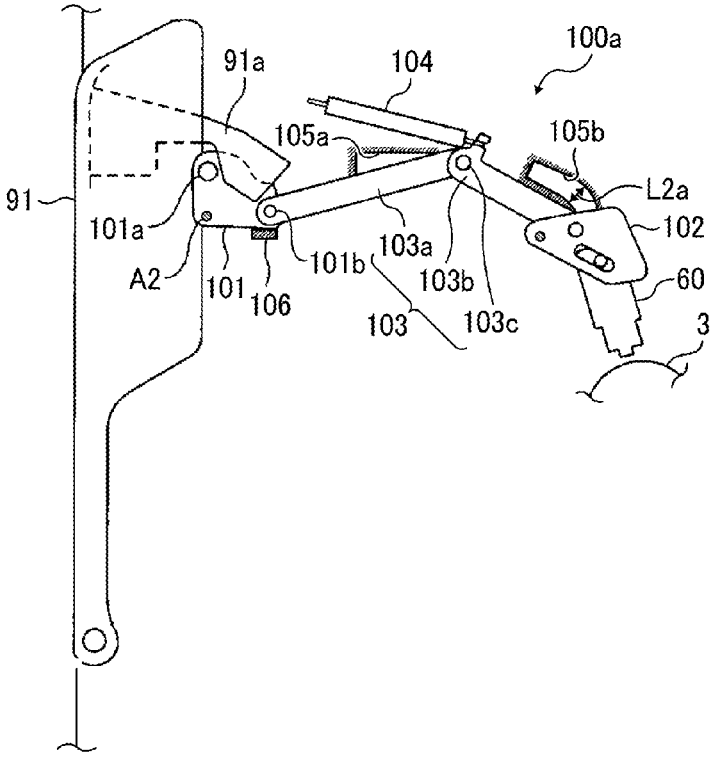
FIG. 9 is a diagram illustrating a relation between a first link unit of the retracting unit and a cover when the cover is closed.
Figure 10:
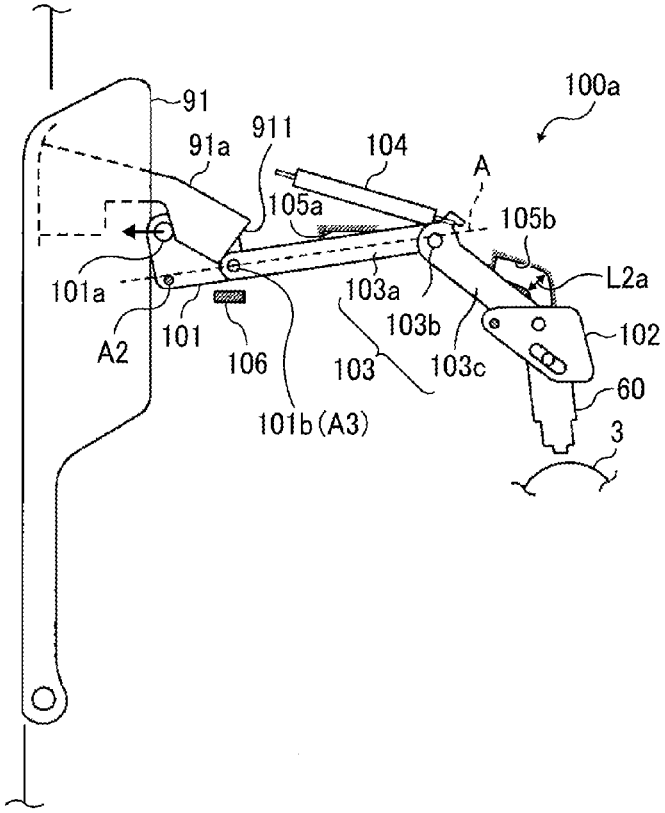
FIG. 10 is a diagram illustrating the relation between the first link unit and the cover when the retracting unit is in the state of FIG. 7.
Figure 11:
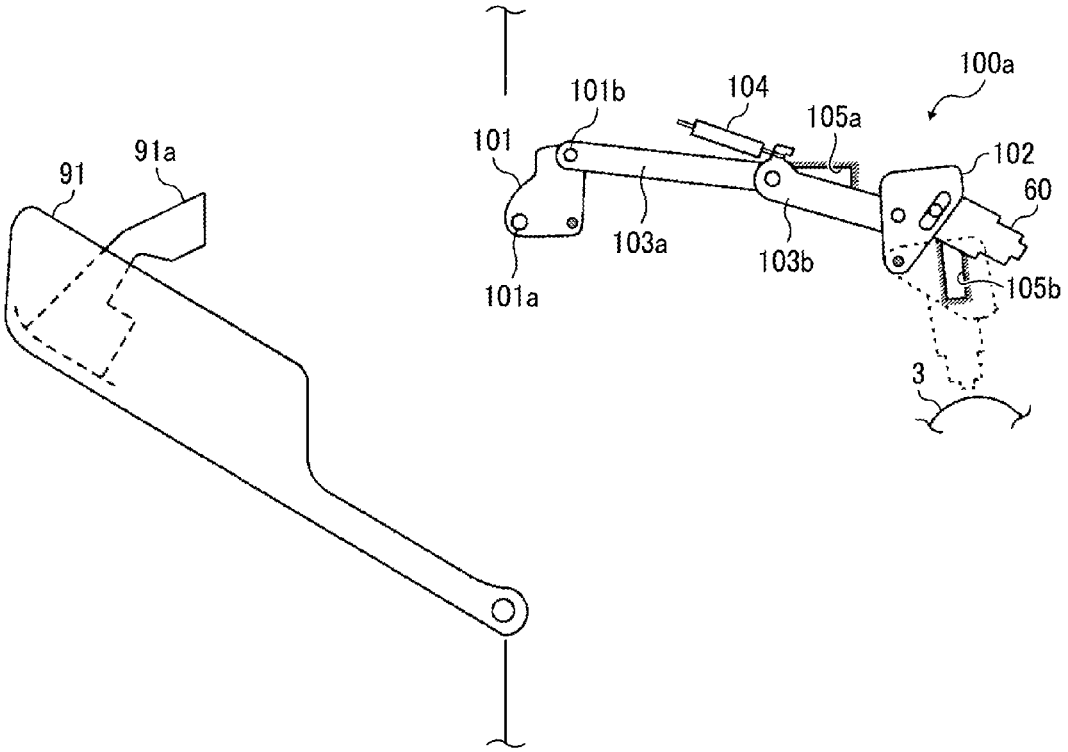
FIG. 11 is a diagram illustrating the cover, the retracting unit, and the photoconductor drum when the cover is open.

FIG. 7 is a diagram illustrating the retracting unit 100 in a state in which the exposure device 60 is moving from the image forming position to the retracted position. FIG. 8 is a diagram illustrating the retracting unit 100 in a state in which the exposure device 60 is located at the retracted position. FIG. 9 is a diagram illustrating a relation between the first link unit 101 of the retracting unit 100 and the cover 91 when the cover 91 is closed. FIG. 10 is a diagram illustrating the relation between the first link unit 101 and the cover 91 when the retracting unit 100 is in the state of FIG. 7. FIG. 11 is a diagram illustrating the cover 91, the retracting unit 100, and the photoconductor drum 3 when the cover 91 is open. In other words, FIGS. 9 through 11 are diagrams illustrating the relations of the first link unit 101 of the retracting unit 100 and the cover 91 when the exposure device 60 is moved from the image forming position to the retracted position.

As illustrated in FIG. 9, the cover 91 includes a hooking lever 91*a* that functions as a hook-shaped acting member to hook the boss section 101*a* of the first link unit 101.

When the cover 91 is closed and the exposure device 60 is located at the image forming position, the hooking lever 91*a* is disposed separated away from the boss section 101*a*.

If the cover 91 has deformation of the cover 91 and/or parts tolerance, the position of the hooking lever 91*a* may be shifted from a regular position to a side the cover 91 opens (the left side in FIG. 9). When the hooking lever 91*a* contacts the boss section 101*a* in a state illustrated in FIG. 9, if the position of the hooking lever 91*a* is shifted to the left in FIG. 9 from the regular position, a force is exerted from the hooking lever 91*a* to the first link unit 101. Consequently, the first link unit 101 turns in the counterclockwise direction in FIG. 9. As a result of this action, the exposure device 60 is moved via the retracting unit 100, and therefore it is likely that the position to the exposure device 60 with respect to the position of the photoconductor drum 3 shifts. Further, if the hooking lever 91*a* vibrates during image formation due to external shock to the cover 91, the exposure device 60 vibrates via the retracting unit 100. This vibration of the exposure device 60 hinders formation of a high-quality electrostatic latent image.

By contrast, in the present example, when the exposure device 60 is at the image forming position, the hooking lever 91*a* is separated from the boss section 101*a*, so that the hooking lever 91*a* and the first link unit 101 remain separated from each other. By so doing, the force that is exerted from the hooking lever 91*a* is not transmitted to the first link unit 101. Accordingly, even if the position of the hooking lever 91*a* is shifted from the regular position to the side the cover 91 opens (the left side in FIG. 9) due to deformation of the cover 91 under the high-temperature environment, the hooking lever 91*a* does not turn the first link unit 101. When compared with a configuration in which the hooking lever 91*a* contacts the boss section 101*a*, the position of the exposure device 60 with respect to the photoconductor drum 3 can be obtained accurately. Further, even if the cover 91 vibrates by external shock, transmission of the vibration to the retracting unit 100 can be prevented. Accordingly, vibration of the exposure device 60 can be prevented.

In the present example, when the exposure device 60 is at the image forming position, the first link unit 101 is biased by the tension spring 104 in a direction opposite to a turning direction of the first link unit 101 to move the exposure device 60 from the image forming position to the retracted position. Therefore, the regulating member 106 is not moved when the first link unit 101 is turned to move the exposure device 60 from the image forming position to the retracted position. Therefore, the regulating member 106 can be fixed to the apparatus body 30. Accordingly, the configuration according to the present example can position the regulating member 106 to the apparatus body 30 more accurately than a configuration in which the regulating member 106 is moved with respect to the apparatus body 30.

As the cover 91 opens, the hooking lever 91*a* contacts the boss section 101*a* and the first link unit 101 turns in the counterclockwise direction in FIG. 10, as illustrated in FIG. 10. At this time, the first link unit 101 is biased by the tension spring 104 in an opposite direction to the turning direction (the counterclockwise direction in FIG. 10) of the first link unit 101 via the connecting unit 103. Therefore, at this time, the hooking lever 91*a* turns the first link unit 101 against a biasing force exerted by the tension spring 104.

When the first link unit 101 is turned to a position illustrated in FIG. 10 against the biasing force applied by the tension spring 104, the support position A3 of the first connecting member 103*a* of the first link unit 101 comes on the line segment A connecting the rotational support A2 of rotation of the first link unit 101 and the connecting shaft 103*c*, as illustrated in FIG. 7. Before the support position A3 of the first connecting member 103*a* reaches the line segment A, the connecting shaft 103*c* moves in a direction separating from the first link unit 101. As a result, the holder 65 of the exposure device 60 presses the spring 66, and therefore the exposure device 60 moves from the image forming position to the position close to the photoconductor drum 3, as illustrated in FIGS. 3A and 3B. As illustrated in FIGS. 3B and 5, when the exposure device 60 is at the image forming position, there is a given gap or space between the guide projection 63 and an end of the exposure device guide slot 105*b* on a side of the photoconductor drum 3. Therefore, until the support position A3 of the first connecting member 103*a* reaches the line segment A, the holder can move from the image forming position to the position close to the photoconductor drum 3.

As the hooking lever 91*a* further turns the first link unit 101 in the counterclockwise direction in the state in which the support position A3 of the first connecting member 103*a* has reached the line segment A, the support position A3 of the first connecting member 103*a* moves above the line segment An in FIG. 7, which is illustrated in FIG. 8. In response to this action, the force applied by the tension spring 104 to move the connecting shaft 103*c* toward the first link unit 101 (to the left side in FIG. 7) generates a force to move the support position A3 in a direction opposite to the direction T1 illustrated in FIG. 5 to the support position A3. Consequently, the first link unit 101 is biased to a direction to turn the first link unit 101 to move the exposure device 60 to the retracted position by the tension spring 104 via the connecting unit 103 (the counterclockwise direction in FIG. 7). As a result, the first link unit 101 automatically turns in the direction to move the exposure device 60 to the retracted position by the biasing force applied by the tension spring 104 (the counterclockwise direction in FIG. 7), and therefore the exposure device 60 moves to the retracted position.

Further, with rotation of the first link unit 101 in the counterclockwise direction, the connecting shaft 103*c* is guided by the connection guide hole 105*a* to move to the cover 91 (the left side in FIG. 7). Then, the second connecting member 103*b* also moves toward the cover 91 (the left side in FIG. 7), and therefore the second link unit 102 turns in the counterclockwise direction about the rotational support A1. Thereafter, the support projection 62 and the guide projection 63 of the exposure device 60, both of which pass through the support slot 102*a* of the second link unit 102 are guided by the exposure device guide slot 105*b* to elevate in a direction to separate from the photoconductor drum 3.

The support slot 102*a* that supports the support projection 62 of the second link unit 102 has a long hole shape extending toward the rotational support A1. According to this form of the support slot 102*a*, the exposure device 60 does not move on a track of an arc but moves linearly in the normal direction of the photoconductor drum 3 from the image forming position to the retracted position while being guided by the exposure device guide slot 105*b*.

Thus, in the present example, the exposure device 60 moves from the image forming position to the retracted position linearly in the normal direction of the photoconductor drum 3. Therefore, even if the charging roller 4 and the developing device 2 are disposed close to the exposure device 60, the charging roller 4 and the developing device 2 do not obstruct movement of the exposure device 60 from the image forming position to the retracted position. Accordingly, this configuration of the present example can achieve a reduction in size of the image forming apparatus 1.

Figure 16:
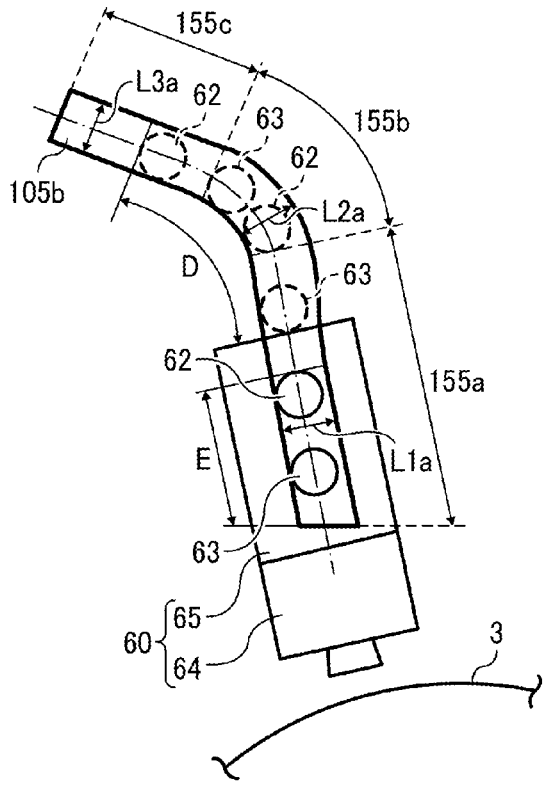
FIG. 16 is a diagram illustrating a schematic configuration of an exposure device guide slot provided to the retracting unit of FIG. 5.

As illustrated in FIG. 16, the exposure device guide slot 105*b* includes a first straight part 155*a*, a curved part 155*b*, and a second straight part 155*c*. The first straight part 155*a* extends linearly in the normal direction of the photoconductor drum 3, which is a direction separating from the surface of the photoconductor drum 3. The second straight part 155*c* extends linearly in a diagonally upward left in FIG. 16, which is a different direction from the first straight part 155*a*. The curved part 155*b* is a portion having a small radius of curvature and connecting the first straight part 155*a* and the second straight part 155*c*. The second straight part 155*c* extends substantially parallel to a detaching direction of the process cartridge 50 as indicated by arrow X1 illustrated in FIG. 8. Therefore, when the support projection 62 is guided to the curved part 155*b* of the exposure device guide slot 105*b*, the exposure device 60 turns in the counterclockwise direction in FIG. 13 about the guide projection 63, resulting in a change of the position of the exposure device 60. Then, as illustrated in FIG. 8, when the guide projection 63 reaches the second straight part 155*c* of the exposure device guide slot 105*b*, the exposure device 60 changes to a retracted attitude that extends parallel to the detaching direction of the process cartridge 50.

Thus, in the present example, the exposure device 60 is moved linearly in the normal direction of the photoconductor drum 3 and then is rotated to the retracted attitude extending substantially parallel to the detaching direction of the process cartridge 50. By so doing, an amount of vertical movement of the exposure device 60 (in FIG. 8) to the retracted position where the exposure device 60 does not hinder detachment and attachment of the process cartridge 50 can be more reduced when compared to a case in which the exposure device 60 is not rotated. Accordingly, vertical space in FIG. 8 in which the exposure device 60 moves between the image forming position and the retracted position can be reduced and, as a result, a reduction in size of the image forming apparatus 1 can be achieved.

Further, as illustrated in FIG. 8, when the exposure device 60 comes to the retracted position, space between the exposure device 60 and an opening of the apparatus body 30 formed by opening the cover 91 is partitioned by the first face 112*a* of the protection member 112. In addition, space between the exposure device 60 and a detaching area of the process cartridge 50 is partitioned by the second face 112*b* of the protection member 112. With this configuration, when the process cartridge 50 is attached to the apparatus body 30 from the opening of the apparatus body 30, even if the process cartridge 50 moves toward the exposure device 60 at the retracted position by some chance, the process cartridge 50 abuts against the protection member 112. Therefore, this configuration can prevent the process cartridge 50 from abutting against the exposure device 60 at the retracted position, and therefore can prevent the exposure device 60 from being damaged or broken. In addition, this configuration can prevent a user from touching the exposure device 60 by the hand inserted through the opening of the apparatus body 30, and therefore can prevent the exposure device 60 from being damaged or broken.

When the exposure device 60 is at the retracted position, the connecting shaft 103*c* contacts an end of the connection guide hole 105*a* on the side of the cover 91 (on the left side in FIG. 8), so as to regulate rotation of the first link unit 101. Further, the tension spring 104 may be with the free length when the exposure device 60 is at the retracted position, and therefore rotation of the first link unit 101 may be stopped.

As described above, in the present example, when the cover 91 is opened, the exposure device 60 moves from the image forming position to the retracted position. Accordingly, the exposure device 60 does not hinder replacement of the process cartridge 50, and therefore the process cartridge 50 can easily be attached to or detached from the apparatus body 30 without any obstacles through the opening of the apparatus body 30 formed by opening the cover 91.

In the present example, if the first link unit 101 is turned in the counterclockwise direction from the state illustrated in FIG. 7, a direction to turn the first link unit 101 is switched by the biasing force applied by the tension spring 104. Therefore, when the exposure device 60 is at the retracted position, the first link unit 101 is biased by the tension spring 104 in a direction to turn the first link unit 101 to move the exposure device 60 from the image forming position to the retracted position.

While the exposure device 60 is located at the retracted position, if the apparatus body 30 of the image forming apparatus 1 receives shock or vibration or if a user touches the first link unit 101 when detaching the process cartridge 50, a force to turn the first link unit 101 in the clockwise direction in FIG. 7 (a direction to turn the first link unit 101 to move the exposure device 60 from the retracted position to the image forming position) may be generated. Thus, even if a force to turn the first link unit 101 in the clockwise direction in FIG. 7, the biasing force applied by the tension spring 104 prevents the first link unit 101 from rotating in the clockwise direction in FIG. 7. Accordingly, this configuration can prevent the exposure device 60 from moving from the retracted position to the image forming position by some chance when the cover 91 is open.

Figure 12:
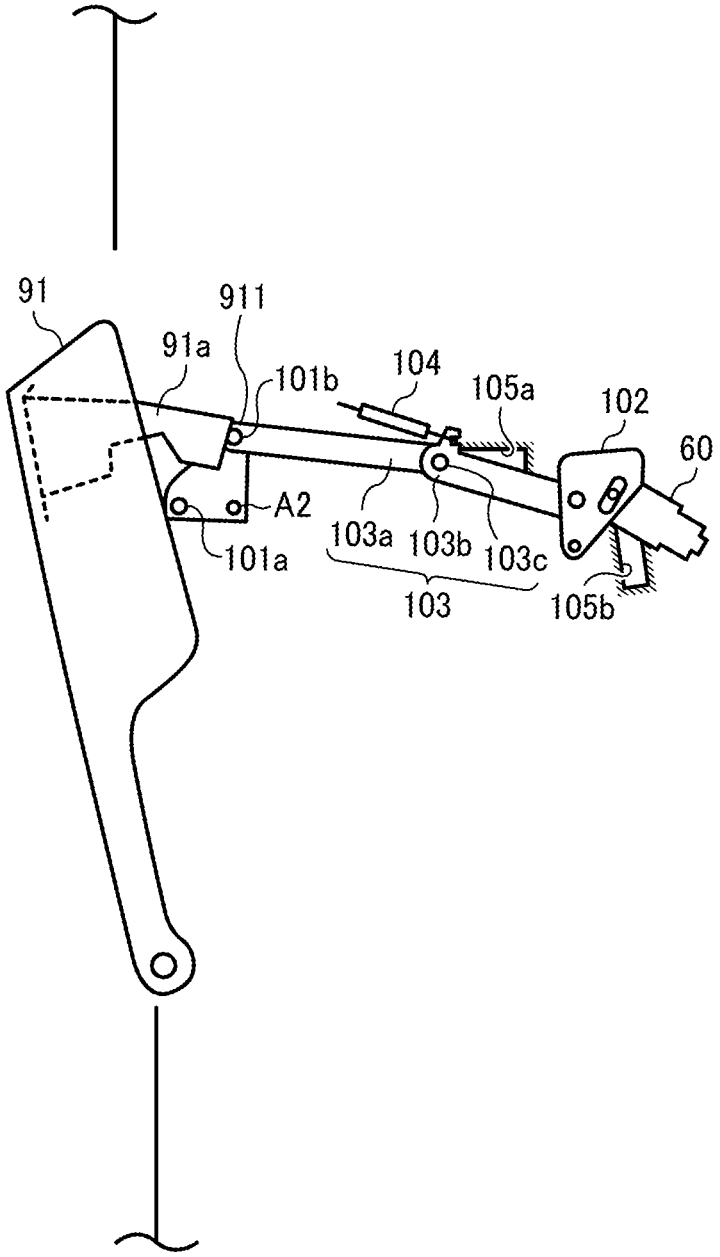
FIG. 12 is a diagram illustrating a relation of the cover and the retracting unit when the cover approaches a closed position.

After replacement of the process cartridge 50 is completed, as the cover 91 is being closed from the state illustrated in FIG. 11, a tip face 911 of the hooking lever 91*a* comes to contact with an attaching part 101*b* that functions as a second contact part, as illustrated in FIG. 12.

As the cover 91 is being closed further from the state illustrated in FIG. 12, the attaching part 101*b* is pressed by the hooking lever 91*a*, so that the first link unit 101 is turned in the clockwise direction in FIG. 12 against the biasing force of the tension spring 104. The tip face 911 of the hooking lever 91*a* presses the attaching part 101*b* to the position illustrated in FIG. 7, so as to rotate the first link unit 101 in the clockwise direction in FIG. 7 against the biasing force of the tension spring 104.

The shapes of the first link unit 101 and the hooking lever 91*a* are considerably designed so that the tip face 911 of the hooking lever 91*a* presses the attaching port 101*b* to the position illustrated in FIG. 7. Specifically, a distance from the rotational support A2 of the first link unit 101 to the attaching part 101*b* is set greater than a distance from the rotational support A2 of the first link unit 101 to the boss section 101*a*. By so doing, as illustrated in FIG. 12, the attaching part 101*b* contacts the tip face 911 of the hooking lever 91*a* in FIG. 7.

Further, the attaching part 101*b* projects by a given length from a recess to which the boss section 101*a* is hooked, so that the tip face 911 of the hooking lever 91*a* can press the attaching part 101*b* to the position illustrated in FIG. 7. Accordingly, the tip face 911 of the hooking lever 91*a* can press the attaching part 101*b* to the position illustrated in FIG. 7.

Then, the tip face 911 of the hooking lever 91*a* presses the attaching part 101*b* further from the position illustrated in FIG. 7, the direction of rotation of the first link unit 101 by the biasing force of the tension spring 104 changes. As a result, the first link unit 101 rotates due to the biasing force applied by the tension spring 104 and abuts against the regulating member 106.

Further, as illustrated in FIG. 3, the exposure device 60 moves while being guided by the exposure device guide slot 105*b*, the positioning bosses 22 are hooked to the positioning holes 67*a* and 67*b*, and the writing head 64 contacts one or both of the spacers 21 so that the writing head 64 is positioned at the image forming position.

Thus, in the retracting unit 100 according to the present example, when the exposure device 60 moves between the image forming position and the retracted position, the direction to turn the first link unit 101 by the biasing force applied by the tension spring 104 changes. Therefore, when the exposure device 60 is located at the image forming position, the first link unit 101 can be biased in the direction to turn the first link unit 101 to move the exposure device 60 from the retracted position to the image forming position by the tension spring 104. Therefore, as described above, when the exposure device 60 is located at the image forming position, the regulating member 106 that regulates rotation of the first link unit 101 is fixed to the apparatus body 30 without retracting when the exposure device 60 is moved from the image forming position to the retracted position. Accordingly, the exposure device 60 can be located to the image forming position precisely.

Further, when the exposure device 60 is located at the retracted position, the tension spring 104 biases the exposure device 60 toward a direction of moving the exposure device 60 from the image forming position to the retracted position. Therefore, as described above, this configuration can prevent the exposure device 60 from moving from the retracted position to the image forming position at replacement of the process cartridge 50. Further, this configuration can prevent the exposure device 60 from being damaged or broken due to contact of the exposure device 60 and the process cartridge 50 during replacement with the exposure device 60.

Further, in the present example, the attitude of the exposure device 60 is changed by the exposure device guide slot 105*b* by fitting multiple projections to the exposure device guide slot 105*b*. However, a single projection can be applied to fit to the exposure device guide slot 105*b* as long as the shape can change the attitude. As an example of the shape of projection that can change the attitude of the exposure device 60, a gourd shape is applicable.

Next, a detailed description is given of the retracting unit 100 according to an example of this disclosure.

Before describing the retracting unit 100 according to an example of this disclosure, a retracting unit 500 according to a comparative example is described with reference to FIGS. 13 through 15.

Figure 13:
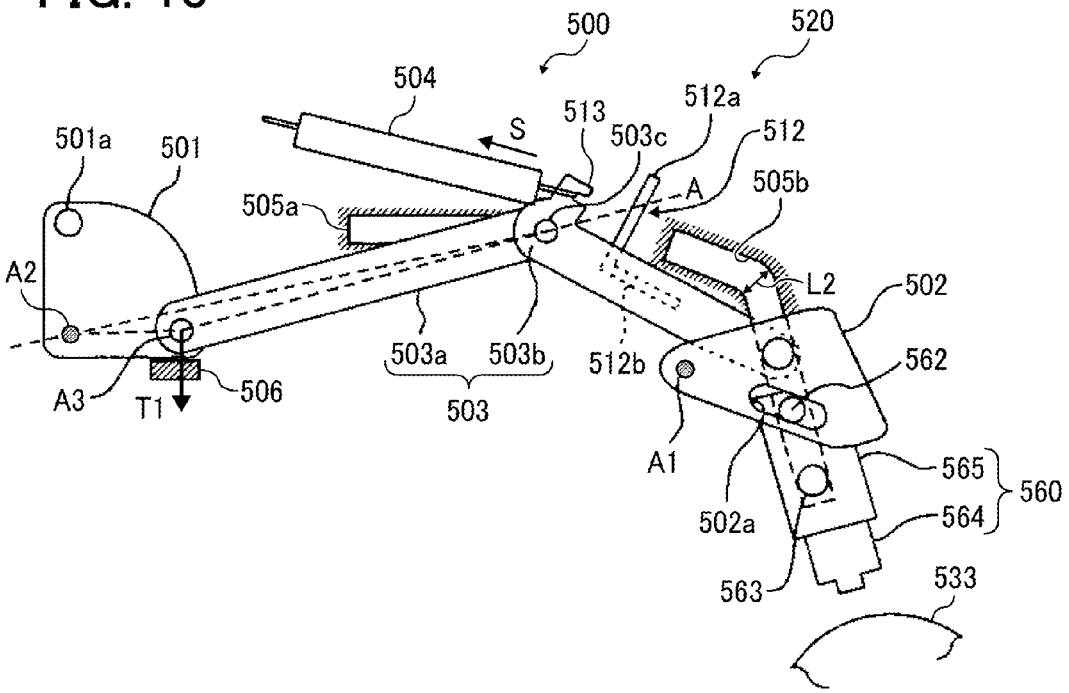
FIG. 13 is a diagram illustrating a retracting unit according to a comparative example.

FIG. 13 is a diagram illustrating the retracting unit 500 according to a comparative example. FIG. 14 is a diagram illustrating an exposure device guide slot 505*b* of the retracting unit 500 of FIG. 13. FIG. 15 is a diagram illustrating a state in which an exposure device 560 is moved to a retracted position in the retracting unit 500 of FIG. 13.

As illustrated in FIG. 13, the retracting unit 500 includes a first link unit 501, a second link unit 502, and a connecting unit 503. The first link unit 501 is rotatably supported by an apparatus body 530. The second link unit 502 that functions as a holder to hold the exposure device 560 that includes a writing head 564 and a holder 565. The second link unit 502 is rotatably supported by the apparatus body 530. The connecting unit 503 connects the first link unit 501 and the second link unit 502.

The connecting unit 503 includes a first connecting member 503*a* and a second connecting member 503*b*. One end of the first connecting member 503*a* is rotatably supported by the first link unit 501 and an opposed end of the first connecting member 503*a* is rotatably supported by a connecting shaft 503*c*. One end of the second connecting member 503*b* is rotatably supported by the connecting shaft 503*c* and an opposed end of the second connecting member 503*b* is rotatably supported by the second link unit 502. The connecting shaft 503*c* passes through a connection guide hole 505*a* of a cover unit. The connection guide bole 505*a* extends toward a cover of the cover unit.

The second link unit 502 has a support slot 502*a* that is an elongated hole extending toward the rotational support A1 of the second link unit 502. A support projection 562, which is provided on both ends in a longitudinal direction of the holder 565 of the exposure device 560, passes through the support slot 502*a*. By causing the support projection 562 of the holder 565 of the exposure device 560 to pass through the support slot 502*a*, the exposure device 560 is supported by the retracting unit 500. As illustrated in FIG. 13, the support projection 562 also passes through the exposure device guide slot 505*b*. Further, the holder 565 of the exposure device 560 includes the guide projection 563 that passes through the exposure device guide slot 505*b*. The exposure device guide slot 505*b* has a width L1 as illustrated in FIG. 13.

The first link unit 501 is a fan-shaped unit having a central angle of approximately 90 degrees. A first connecting member 503*a* is rotatably supported at one end in a circumferential direction of the first link unit 501. A boss section 501*a* is disposed at an opposed end in the circumferential direction of the first link unit 501.

A protection member 512 is provided to protect the exposure device 560 at the retracted position. The protection member 512 extends in the longitudinal direction of the exposure device 560. The protection member 512 includes a first face 512*a* and a second face 512*b* that extends in the direction perpendicular to the first face 512*a*.

A hook 513 is disposed at one end side of the second connecting member 503*b*, at which the second connecting member 503*b* is rotatably supported by the connecting shaft 503*c*. The hook 513 hooks one end of a tension spring 504. By so doing, the tension spring 504 biases the second connecting member 503*b* to the direction S illustrated in FIG. 13.

Due to a biasing force generated by the tension spring 504, the connecting shaft 503*c* receives a force to move to the first link unit 501. At this time, the support position A3 of the first connecting member 503*a* is located below a line segment A connecting the rotational support A2 about which the first link unit 501 turns and the connecting shaft 503*c* in FIG. 13. Consequently, a force applied to move the connecting shaft 503*c* to the first link unit 501 generates a force to move to the support position A3 in the direction T1 in FIG. 13. As a result, the first link unit 501 contacts against a regulating member 506.

Figure 14:
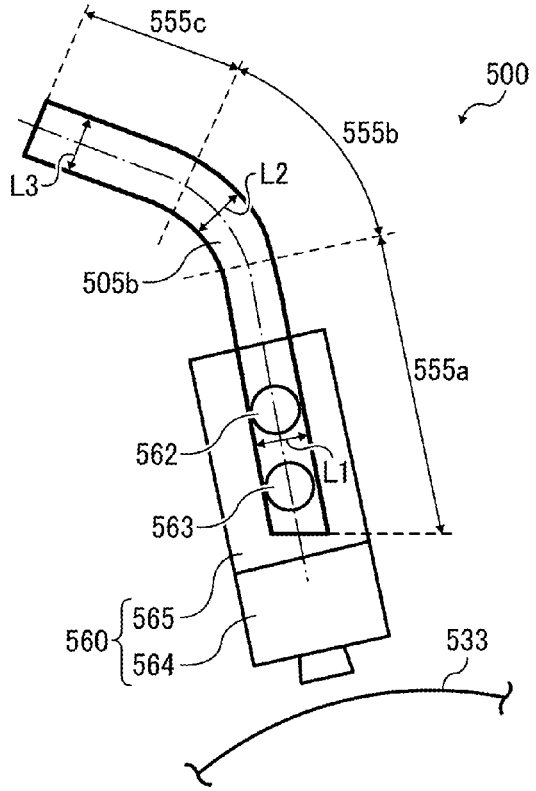
FIG. 14 is a diagram illustrating an exposure device guide slot of the retracting unit of FIG. 13.
Figure 15:
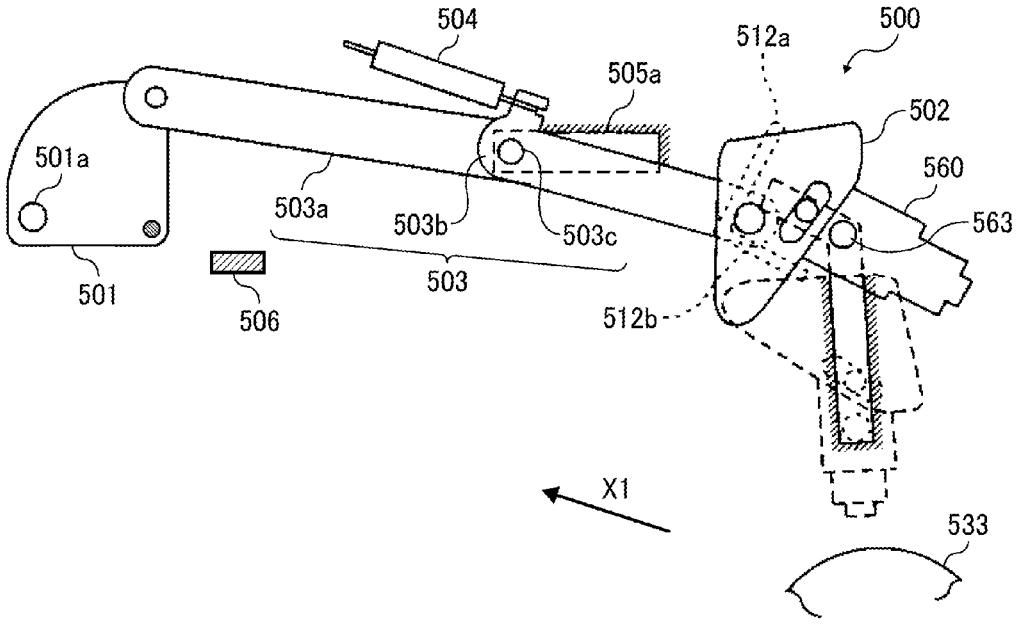
FIG. 15 is a diagram illustrating a state in which the exposure device is moved to a retracted position in the retracting unit of FIG. 13.

An illustrated in FIG. 14, in a configuration of the comparative example, "L1" represents a width of the first straight part 555*a*, "L2" represents a width of the curved part 555*b*, and "L3" represents a width of the second straight part 555*c*, and a relation of the widths L1, L2, and L3 are equal (L1=L2=L3). The exposure device guide slot 505*b* has equal widths at any portions thereof and the width of the exposure device guide slot 505*b* is substantially equal to the diameter of the support projection 562 and the diameter of the guide projection 563. Therefore, the support projection 562 and the guide projection 563 have substantially zero amount of play in the exposure device guide slot 505*b*.

However, as described above in the comparative example, there was a case that, even though the retracting unit connecting member 507 connected these retracting units 500, the retracting units 500 operated with slight time lag due to tolerance of parts used in the retracting units 500.

If the operation of the retracting unit 500 on the opposed end side delays from the operation of the retracting unit 500 on the one end side, the exposure device 560 moves from the image forming position to the retracted position in a state in which the exposure device 560 is slightly tilted in the longitudinal direction thereof. Even when the support projection 562 on the one end side of the exposure device 560 reaches the curved part 555*b* of the exposure device guide slot 505*b* as illustrated in FIG. 14, the support projection 562 on the opposed end side of the exposure device 560 is still moving along the first straight part 555*a*. As a result, while the retracting unit 500 on the one end side pivots in the counterclockwise direction in FIG. 14 and the attitude of the exposure device 560 starts to change, the retracting unit 500 on the opposed end side has not yet moved and therefore the altitude of the exposure device 560 has not yet changed. Accordingly, respective movements of the retracting units 500 for changing the attitude of the exposure device 560 are shifted in timing.

As illustrated in FIG. 14, when the widths at any portions of the entire exposure device guide slot 505*b* are substantially equal to the diameter of the support projection 562 and the diameter of the guide projection 563 and the support projection 562 and the guide projection 563 have substantially zero amount of play in the exposure device guide slot 505*b*, if timing shift in attitude change of the exposure device 560 occurs between the retracting units 500, the retracting unit 500 on the opposed end side cannot follow the attitude change of the retracting unit 500 on the one end side, the exposure device 560 is twisted or distorted. Consequently, resilience is created to eliminate the distortion of the exposure device 560. The resilience generates a force on the opposed end side of the exposure device 560 to turn the exposure device 560 in the counterclockwise direction in FIG. 14 and another force on the one end side of the exposure device 560 to turn the exposure device 560 in a clockwise direction in FIG. 14. As a result, the support projection 562 is pressed against a left edge (in FIG. 14) of the first straight part 555*a* and the guide projection 563 is pressed against a right edge (in FIG. 14) of the first straight part 555*a* at the retracting unit 500 on the opposed end side and, by contrast, the support projection 562 is pressed against an upper edge (in FIG. 14) of the curved part 555*b* and the guide projection 565 is pressed against the left edge (in FIG. 14) of the first straight part 555*a* at the retracting unit 500 on the one end side.

As described above, it has been found that, if the support projection 562 and the guide projection 563 provided to the retracting units 500 on both ends of the exposure device 560 are pressed strongly against the exposure device guide slot 505*b*, a frictional force generated between the exposure device guide slot 505*b* and the support projection 562 and/or between the exposure device guide slot 505*b* and the guide projection 563 increases, which prevents smooth movement of the exposure device 560 of a retracting device 520 according to the comparative example. Accordingly, the exposure device 560 cannot move between the image forming position and the retracted position smoothly.

The twist or distortion of the exposure device 560 occurs more frequently as the longitudinal length of the exposure device 560 increases. For example, the exposure device 560 having a longitudinal length for an A3 portrait sheet is twisted or distorted more than the exposure device 560 having a longitudinal length for an A4 portrait sheet.

In the present example, as illustrated in FIG. 4, the retracting unit connecting member 107 connects the retracting units 100*a* and 100*b* at both longitudinal ends of the exposure device 60 so that the retracting units 100*a* and 100*b* operate integrally. In the present example, as described above, the exposure device 60 is moved to the retracted position by the biasing member of the tension spring 104 after the state illustrated in FIG. 7. Therefore, as described in the comparative example above, if the support projection 62 and the guide projection 63 provided to the retracting units 100 on both ends of the exposure device 60 are pressed strongly against the exposure device guide slot 105*b* due to twist or distortion of the exposure device 60, the frictional force generated between the exposure device guide slot 105*b* and the support projection 62 and/or the exposure device guide slot 105*b* and the guide projection 63 increases to be greater than the biasing force of the tension spring 104. As a result, it is not likely that the exposure device 60 does not reach the retracted position.

In order to address the inconvenience, the exposure device guide slot 105*b* provided to the retracting unit 100 according to the present example of this disclosure includes a configuration as illustrated in FIG. 16.

FIG. 16 is a diagram illustrating a schematic configuration of the exposure device guide slot 105*b* provided to the retracting unit 100 of FIG. 5.

As illustrated in FIG. 16, the exposure device guide slot 105*b* includes a range D where the attitude of the exposure device 60 is changed and a range E where the support projection 62 and the guide projection 63 are located when the exposure device 60 is at the image forming position, and the width of at least a part of the range D is wider than the width of the range E. Accordingly, an amount of play in at least a part of the range D with respect to the support projection 62 and the guide projection 63 is greater than an amount of play in the range E.

The range D of the exposure device guide slot 105*b* that changes the attitude of the exposure device 60 extends from a position at which the guide projection 63 is located when the support projection 62 arrives at the curved part 155*b* to a position at which the support projection 62 is located when the guide projection 63 exits the curved part 155*b*. Specifically, the range D changes the attitude of the exposure device 60 in the range between one side of the first straight part 155*a* to the curved part 155*b* and one side of the second straight part 155*c* to the curved part 155*b*. By increasing the amount of the width of a part of the range D to be greater than the amount of the width of the range E where the support projection 62 and the guide projection 63 are disposed when the exposure device 60 is located at the image forming position, the amount of play in the range D with respect to the support projection 62 and the guide projection 63 is made to be greater than an amount of play in the range E.

The attitude of the exposure device 60 starts to change on arrival of the support projection 62 at the curved part 155*b*. At this time, if the width of the exposure device guide slot 105*b* on the side close to the retracted position is greater than the width thereof where the guide projection 63 is located, even when the time lag occurs in the change of the attitude of the exposure device 60 at the one end side and the opposed end side thereof, the guide projection 63 and the support projection 62 move in a width direction of the exposure device guide slot 105*b*. Accordingly, the attitude of the exposure device 60 at the one end side (the opposed end side) thereof can be changed following the change of the attitude of the exposure device 60 at the opposed end side (the one end side) thereof.

The change of the attitude of the exposure device 60 completes when the guide projection 63 exits the curved part 155*b*. Thereafter, the exposure device 60 is not twisted or distorted. Therefore, there is no need to make the width of the exposure device guide slot 105*b* on the side close to the retracted position greater than the width of the exposure device guide slot 105*b* where the support projection 62 is located when the guide projection 63 passes the curved part 155*b*.

In the configuration of the exposure device guide slot 105*b* illustrated in FIG. 16, a relation of widths L1*a*, L2*a*, and L3*a* is described or shown in the following inequality, where "L1*a*" represents the width of the range E, "L2*a*" represents the width of the range D, and "L3*a*" represents the width of the exposure device guide slot 105*b* at the retracted position, $$L2a=L3a>L1a.$$

The width L1*a* is greater than the diameter of the support projection 62 and the diameter of the guide projection 63 and the support projection 62 and the guide projection 63 have substantially zero amount of play in the exposure device guide slot 105*b*.

If the operation of the retracting unit 100*b* on the opposed end side delays from the operation of the retracting unit 100*a* on the one end side, the support projection 62 on the one end side reaches the curved part 155*b* before the support projection 62 on the opposed end side. The support projection 62 on the one end side is guided to the curved part 155*b* and then moves to the left side in FIG. 16. As a result of this action, the one end side of the exposure device 60 tilts to the left side in FIG. 16.

With the configuration according to the comparative example illustrated in FIG. 14, when the one end side of the exposure device 560 tilts, the opposed end side of the exposure device 560 cannot tilt following the action of the one end side of the exposure device 560 and is twisted or distorted.

However, in the present example, when the support projection 62 on the one end side is guided to the curved part 155*b*, the guide projection 63 and the support projection 62 on the opposed end side are located in the range D and there is a given space (play) in a width direction of the exposure device guide slot 105*b* between the guide projection 63 and the exposure device guide slot 105*b*. Accordingly, when the one end side of the exposure device 60 tilts to the left side in FIG. 16, the guide projection 63 on the opposed end side moves in the exposure device guide slot 105*b* to the right side in FIG. 16, then the support projection 62 on the opposed end side moves in the exposure device guide slot 105*b* to the left side in FIG. 16, and therefore the opposed end side of the exposure device 60 tilts to the left side in FIG. 16 following the tilt of the one end side of the exposure device 60.

When the shift or deviation of time in the action of the retracting unit 100*a* on the one end side and the action of the retracting unit 100*b* on the opposed end side is relatively small, the guide projection 63 and the support projection 62 on the opposed end side do not hit the left side of the exposure device guide slot 105*b*, and therefore the opposed end side of the exposure device 60 tilts the one end side of the exposure device 60 by the same amount. As a result, the exposure device 60 moves to the retracted position while changing the attitude without being twisted or distorted.

By contrast, when the shift or deviation of time in the action of the retracting unit 100*a* on the one end side and the action of the retracting unit 100*b* on the opposed end side is relatively large, the guide projection 63 and the support projection 62 on the opposed end side hit or abut against the exposure device guide slot 105*b*. Consequently, the opposed end side of the exposure device 60 cannot move further to the left side, and therefore the exposure device 60 is twisted or distorted. However, when compared with the configuration of the comparative example illustrated in FIG. 14, the twist or distortion of the exposure device 60 is reduced, and the support projection 62 and the guide projection 63 are not pressed against the exposure device guide slot 105*b* strongly. Therefore, even if the exposure device 60 is twisted or distorted, the frictional force generated between the exposure device guide slot 105*b* and the support projection 62 and/or between the exposure device guide slot 105*b* and the guide projection 63 does not increase greater than the biasing force applied by the tension spring 104. Accordingly, the exposure device 60 can be moved to the retracted position by the biasing force applied by the tension spring 104.

Next, a description is given of the exposure device guide slot 105*b* according to another example of this disclosure.

Figure 17:
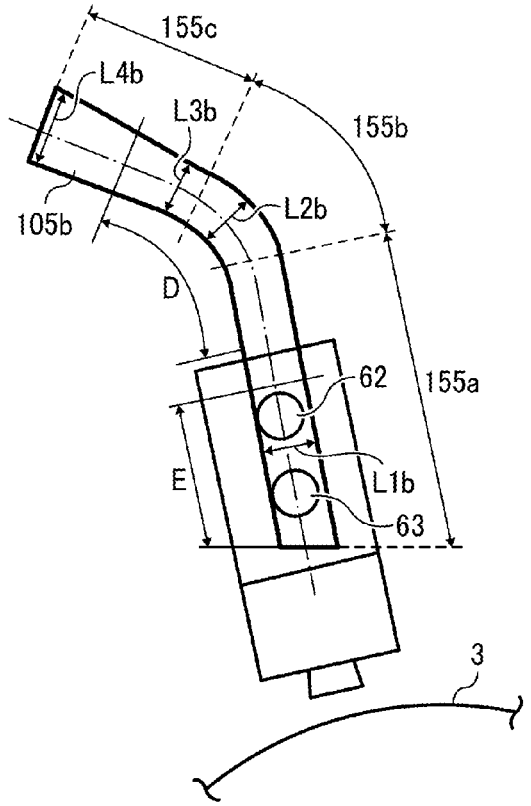
FIG. 17 is a diagram illustrating a schematic configuration of an exposure device guide slot according to another example of this disclosure.

FIG. 17 is a diagram illustrating a schematic configuration of the exposure device guide slot 105*b* according to another example of this disclosure.

As illustrated in FIG. 17, the exposure device guide slot 105*b* in the configuration is gradually increased in the width of the second straight part 155*c* toward the retracted position. That is, the amount of play in the second straight part 155*c* of the exposure device guide slot 105*b* with respect to the support projection 62 and the guide projection 63 is gradually increased from one side of the second straight part 155*c* to the curved part 155*b* toward the retracted position. Specifically, the width of the second straight part 155*c* is increased upwardly toward the retracted position in FIG. 17. In other words, an upper part in a vertical direction of the second straight part 155*c* is tilted upwardly in an extending direction or a direction in which the second straight part 155*c* extends toward the retracted position. In the configuration of the exposure device guide slot 105*b* illustrated in FIG. 17, a relation of widths L1*b*, L2*b*, L3*b*, and L4*b* is described or shown in any one of the following inequalities, where "L1*b*" represents the width of the first straight part 155*a*, "L2*b*" represents the width of the curved pan 155*b*, "L3*b*" represents the width of the second straight part 155*c* at a part close to the curved part 155*b*, and "L4*b*" represents the width of the retracted position, $$L4b>L3b=L2b=L1b;$$

and $$L4b>L3b=L2b>L1b.$$

If the amount of delay of time in movement of the retracting unit 100 on the opposed end side with respect to the retracting unit 100 on the one end side is relatively small, the relation of the widths L1, L2, and L3 are described as L3=L2=L1, and the first straight part 155*a* in the range D on the side of the curved part 155*b* and the width of the curved part 155*b* are set to be same as the diameter of the guide projection 63 and the diameter of the support projection 62. By so doing, there is substantially no play or zero amount of play in the range D with the guide projection 63 and the support projection 62, and therefore the exposure device 60 is less twisted or distorted. Further, even if there is a certain amount of delay of the retracting unit 100 on the opposed end side with respect to the retracting unit 100 on the one end side, the twist or distortion of the exposure device 60 can be reduced when the relation of widths L1, L2, and L3 is set to be L3=L2>L1.

As described above, when the amount of twist or distortion of the exposure device 60 is relatively small, the resilience to restore the attitude of the exposure device 60 becomes weak, and therefore the contact pressure between the support projection 62 and the exposure device guide slot 105*b* or between the guide projection 63 and the exposure device guide slot 105*b* is reduced. Accordingly, the biasing force of the tension spring 104 is greater than the frictional force between the support projection 62 and the exposure device guide slot 105*b* or between the guide projection 63 and the exposure device guide slot 105*b*, and therefore the support projection 62 moves along the curved part 155*b* smoothly.

However, even when the amount of twist or distortion of the exposure device 60 is relatively small, the biasing force applied by the tension spring 104 may not be sufficient to move the exposure device 60, and therefore the exposure device 60 may stop at the exit of the curved part 155*b*, which is where the support projection 62 is just completed passing through the curved part 155*b*.

Specifically, the own weight of the exposure device 60 may hinder and stop movement of the exposure device 60 by the biasing force applied by the tension spring 104 at the position where the support projection 62 on the one end side (e.g., the leading end side of the exposure device 60) has just passed through the curved part 155*b*. Specifically, as the support projection 62 on the one end side or the leading end side of the exposure device 60 in the longitudinal direction of the exposure device 60 is guided by the curved part 155*b*, the exposure device 60 tilts, and a force to move the support projection 62 in a diagonally upward right in FIG. 17 is exerted to the support projection 62 due to the own weight of the exposure device 60. The support projection 62 on the leading end side of the exposure device 60 presses the exposure device guide slot 105*b* in a diagonally upward right in FIG. 17 due to the resilience of the exposure device 60 from the twist or distortion thereof. As a result, the force of the support projection 62 on the leading end side of the exposure device 60 pressing the exposure device guide slot 105*b* becomes equal to the resilience of the exposure device 60 and the own weight of the exposure device 60. Consequently, the frictional force between the support projection 62 on the one end side of the exposure device 60 and the exposure device guide slot 105*b* at the exit of the curved part 155*b* is greater than the biasing force applied by the tension spring 104, and therefore the exposure device 60 cannot move and stops.

In the configuration illustrated in FIG. 17 according to the present example, when the support projection 62 on the leading end side of the exposure device 60 passes through the curved part 155*b*, the support projection 62 on the leading end side of the exposure device 60 moves upwardly along the exposure device guide slot 105*b* so that the amount of twist or distortion of the exposure device 60 is reduced, and therefore the resilience of the exposure device 60 from the twist or distortion is reduced. As a result, the configuration illustrated in FIG. 17 can reduce the frictional force between the support projection 62 and the exposure device guide slot 105*b* exerted at the exit of the curved part 155*b* when the support projection 62 on the leading end side of the exposure device 60 passes through the curved part 155*b*. Consequently, the configuration illustrated in FIG. 17 can prevent the frictional force between the support projection 62 and the exposure device guide slot 105*b* from increasing to be greater than the biasing force applied by the tension spring 104, thereby moving the exposure device 60 to the retracted position reliably.

Next, a description is given of the exposure device guide slot 105*b* according to yet another example of this disclosure.

Figure 18:
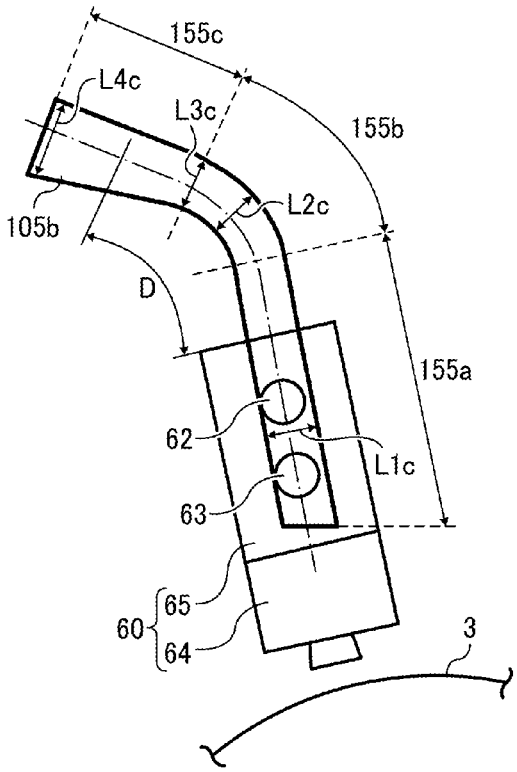
FIG. 18 is a diagram illustrating a schematic configuration of an exposure device guide slot according to yet another example of this disclosure.

FIG. 18 is a diagram illustrating a schematic configuration of the exposure device guide slot 105*b* according to yet another example of this disclosure.

As illustrated in FIG. 18, the exposure device guide slot 105*b* in this configuration is gradually increased in the width of the second straight part 155*c* downwardly toward the retracted position. In the configuration of the exposure device guide slot 105*b* illustrated in FIG. 18, a relation of widths L1*c*, L2*c*, L3*c*, and L4*c* is described or shown in any one of the following inequalities, where "L1*c*" represents the width of the first straight part 155*a*, "L2*c*" represents the width of the curved part 155*b*, "L3*c*" represents the width of the second straight part 155*c* at the part close to the curved part 155*b*, and "L4*c*" represents the width of the retracted position, $$L4c>L3c=L2c=L1c;$$

and $$L4c>L3c=L2c>L1c.$$

That is, the relation of the widths L1*c* through L4*c* in the configuration of FIG. 18 is the same as the relation of the widths L1*b* through L4*b* in the configuration of FIG. 17.

As illustrated in FIG. 18, by increasing the width of the second straight part 155*c* downwardly, the vertical position of the exposure device 60 at the retracted position can be moved lower than the position of the exposure device 60 at the retracted position in the configuration illustrated in FIG. 17 where the width of the second straight part 155*c* increases upwardly. In other words, a lower part in the vertical direction of the second straight part 155*c* is tilted downwardly in the extending direction toward the retracted position. As a result, a reduction in size of the image forming apparatus 1 in the vertical direction can be achieved.

In the configuration illustrated in FIG. 18, when a delayed one of the support projection 62 on the one end side and the support projection 62 on the opposed end side passes through the curved part 155*b*, the delayed support projection 62 moves downward in the second straight part 155*c* of the exposure device guide slot 105*b*, thereby reducing the amount of twist or distortion of the exposure device 60. Further, if the configuration illustrated in FIG. 18 has the relation of the widths L1*c*, L2*c*, L3*c*, and L4*c* described with the inequality of L4*c*>L3*c*=L2*c*>L1*c*, the amount of twist or distortion of the exposure device 60 is further reduced at the position where the delayed support projection 62 passes through the curved part 155*b*.

Next, a description is given of the exposure device guide slot 105*b* according to yet another example of this disclosure.

Figure 19:
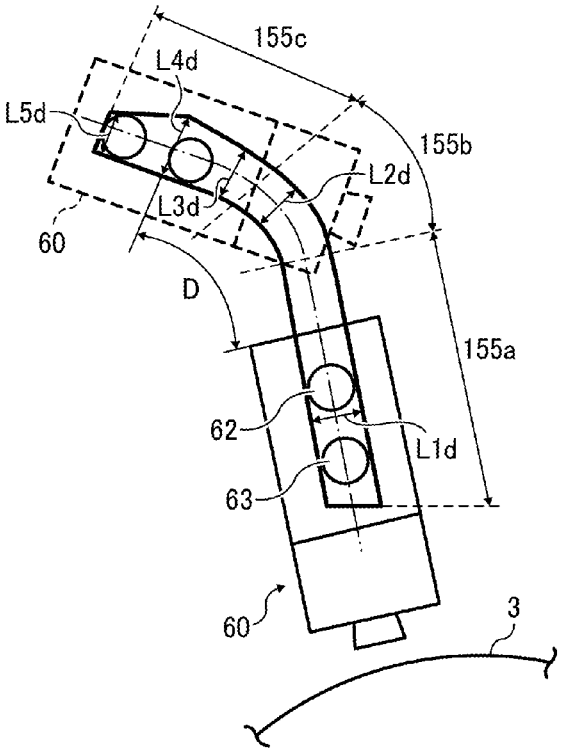
FIG. 19 is a diagram illustrating a schematic configuration of an exposure device guide slot according to yet another example of this disclosure.

FIG. 19 is a diagram illustrating a schematic configuration of the exposure device guide slot 105*b* according to yet another example of this disclosure.

As illustrated in FIG. 19, the exposure device guide slot 105*b* in this configuration is gradually increased in the width of the second straight part 155*c* to the center part of the second straight part 155*c* toward the retracted position and is gradually tapered or reduced from the center part of the second straight part 155*c* to the retracted position. In other words, the amount of play in the second straight part 155*c* of the exposure device guide slot 105*b* with respect to the support projection 62 and the guide projection 63 is gradually increased from one side of the second straight part 155*c* to the curved part 155*b* to the center part of the second straight part 155*c* and is gradually reduced from the center part of the second straight part 155*c* to the retracted position. That is, a width of the second straight part 155*c* is the largest at the center part of the second straight part 155*c*. In the configuration of the exposure device guide slot 105*b* illustrated in FIG. 19, a relation of widths L1*d*, L2*d*, L3*d*, L4*d*, and L5*d* is described or shown in any one of the following inequalities, where "L1*d*" represents the width of the first straight part 155*a*, "L2*d*" represents the width of the curved part 155*b*, "L3*d*" represents the width of the second straight part 155*c* at the part close to the curved part 155*b*, "L4*d*" represents a width of the center part of the second straight part 155*c*, and "L5*d*" represents the width of the retracted position, $$L4d>L3d=L2d=L1d>L5d;$$

$$L4d>L3d=L2d>L1d>L5d;$$

$$L4d>L3d=L2d=L1d=L5d;$$

and $$L4d>L3d=L2d=L5d>L1d;$$

The configuration illustrated in FIG. 19 enables the exposure device 60 to move smoothly in the exposure device guide slot 105*b* until the support projection 62 on the leading end side of the exposure device 60 reaches the center part of the second straight part 155*c*, which can achieve the same effect as the above-described configuration illustrated in FIG. 17. In the configuration illustrated in FIG. 19, at and after the exposure device 60 has reached the retracted position, movement of the support projection 62 in the vertical direction, which is the width direction of the exposure device guide slot 105*b* at the retracted position, is restricted due to the shape of the exposure device guide slot 105*b*. As a result, the attitude of the exposure device 60 at the retracted position can remain stable.

The configurations according to the above-described embodiment are examples. The present invention can achieve the following aspects effectively.

Aspect 1.

In Aspect 1, a retractor (for example, the retracting device 20) includes a moving unit (for example, the retracting unit 100), a first guide (for example, the exposure device guide slot 105*b* on the one end side), and a second guide (for example, the exposure device guide slot 105*b* on the opposed end side). The moving unit moves a latent image forming device (for example, the exposure device 60) that forms an electrostatic latent image on a surface of a latent image bearer (for example, the photoconductor drum 3) between an image forming position at which the latent image forming device forms the latent image on the surface of the latent image bearer and a retracted position at which the latent image forming device stays away from the latent image forming device. The first guide is a guide into which a first projection (for example, the guide projection 63 and the support projection 62) provided on one end side of the latent image forming device in a longitudinal direction of the latent image forming device is fitted in different ranges and changes an attitude of the one end side of the latent image forming device while guiding the first projection. The second guide is a guide into which a second projection (for example, the guide projection 63 and the support projection 62) provided on an opposed end side of the latent image forming device in the longitudinal direction of the latent image forming device is fitted in different ranges and changes the attitude of the opposed end side of the latent image forming device while guiding the second projection. The different ranges of each of the first guide and the second guide includes a first range where the altitude of each of the one end side and the opposed end side of the latent image forming device is changed and a second range where a corresponding projection of the first projection and the second projection is located when the latent image forming device is at the image forming position. An amount of play in at least a part of the first range with respect to the corresponding projection is greater than an amount of play in the second range.

In the retracting device 520 according to the comparative example, when the exposure device 560 as the latent image forming device is at the image forming position, in order not to rattle the exposure device 560, the width of the exposure device guide slot 505*b* as a guide is made substantially identical to the diameter of the guide projection 563 and the width of the support projection 562. Further, as illustrated in FIG. 14, the width L1 of the first straight part 555*a*, the width L2 of the curved part 555*b*, and the width L3 of the second straight part 555*c* are equal to each other (L1=L2=L3). Therefore, the widths at any portions of the entire exposure device guide slot 505*b* are substantially equal to the diameter of the support projection 562 and the diameter of the guide projection 563. According to this configuration, the support projection 562 and the guide projection 563 have substantially no play in the exposure device guide slot 505*b* in an attitude changing area where the exposure device 560 changes its attitude. As a result, timing shift in attitude change of the exposure device 560 occurs between the retracting unit 500 on the one end side and the retracting unit 500 on the opposed end side. When the retracting unit 500 on the one end side is guided by the exposure device guide slot 105*b* to change the attitude of the exposure device 560 before the retracting unit on the opposed end side is guided, the support projection 62 and the guide projection 63 connected to the retracting unit 500 on the opposed end side cannot move in the width direction of the exposure device guide slot 105*b*. Consequently, the refracting unit 500 on the opposed end side cannot follow the attitude change of the retracting unit 500 on the one end side, the exposure device 560 is twisted or distorted.

It is to be noted that the time lag of movement between both end sides of the exposure device 560 occurs even if the retracting unit 500 is mounted on either the one end side or the opposed end side, resulting in twist or distortion of the exposure device 560.

By contrast, in Aspect 1, there is a play in each of the first guide and the second guide where the attitude of the latent image forming device with respect to the projection. Since the amount of play in this range is made to be greater than an amount of play in a range where the projection is disposed when the latent image forming device is located at the image forming position, the projection can move within the given width range. Therefore, there is deviation of time in movements of the one end side and the opposed end side of the latent image forming device. Accordingly, when the attitude of the latent image forming device at the one end side thereof is changed while being guided by the first guide prior to the opposed end side of the latent image forming device, the projection on the opposed end side of the latent image forming device, which is located in a range where the attitude of the latent image forming device changes, moves in the width direction of the second guide. Then, the opposed end side of the latent image forming device follows the movement of the one end side thereof until the projection on the opposed end side of the latent image forming device contacts an edge in the width direction of the second guide, so that the attitude of the opposed end side of the latent image forming device can be changed. Therefore, the twist or distortion of the latent image forming device can be prevented. As a result, when compared with the retracting device of the comparative example, the projection of the examples described above can prevent from strongly abutting against the first guide or the second guide when the attitude of the latent image forming device changes, and therefore an increase in frictional force between the projection and a corresponding one of the first guide and the second guide can be prevented. Consequently, a load that is applied when the latent image forming device moves from the image forming position to the retracted position can be reduced and, even if deviation of time in movements of the one end side of the latent image forming device and the opposed end side thereof is generated, the latent image forming device can be moved smoothly.

Further, when the latent image forming device is located at the image forming position in each of the first guide and the second guide, the amount of play in each of the first guide and the second guide with respect to the projection where the projection is located is small, and therefore the latent image forming device is prevented from rattling at the image forming position.

Aspect 2.

In Aspect 1, each of the first guide (for example, the exposure device guide slot 105*b* on the one end side) and the second guide (for example, the exposure device guide slot 105*b* on the opposed end side) includes a first straight part (for example, the first straight part 155*a*) extending in a direction separating from the surface of the latent image bearer, a second straight part (for example, the second straight part 155*c*) extending in a direction different from the first straight part, and a curved part (for example, the curved part 155*b*) connecting the first straight part and the second straight part. An amount of play in at least one of the curved part, one side of the first straight part to the curved part, and one side of the second straight part to the curved part with respect to a corresponding one of the first projection and the second projection is greater than an amount of play in each of the first guide and the second guide with respect to a position of a corresponding one of the first projection and the second projection where the corresponding one of the first projection and the second projection is disposed when the latent image forming device is located at the image forming position.

Consequently, as described in the examples above, when the attitude of the latent image forming device (for example, the exposure device 60) at the one longitudinal end thereof changes, the projection on the opposed longitudinal end of the latent image forming device moves in the width direction of the second guide. Thereafter, following the change of attitude of the latent image forming device on the one end side, the latent image forming device on the opposed end side can be changed.

Aspect 3.

In Aspect 2, the amount of play in the second straight part (for example, the second straight part 155*c*) of each of the first guide and the second guide with respect to a corresponding one of the first projection and the second projection is gradually increased from the one side of the second straight part to the curved part toward the retracted position.

Consequently, as described in the example illustrated in FIG. 17, the twist or distortion of the latent image forming device (for example, the exposure device 60) can be reduced immediately after the projection has passed through the curved part. Therefore, the latent image forming device can move smoothly.

Aspect 4.

In Aspect 3, the upper part in the vertical direction of the second straight part (for example, the second straight part 155*c*) is tilted in the extending direction or the direction in which the second straight part extends toward the retracted position.

Consequently, as described in the above-described example with FIG. 17, when the projection (for example, the support projection 62) on one end side of the latent image forming device (for example, the exposure device 60) that moves prior to the other projection on the other end side of the latent image forming device passes through the curved part (for example, the curved pan 155*b*), the amount of twist or distortion of the latent image forming device is reduced. As a result, the latent image forming device can move smoothly.

Aspect 5.

In Aspect 3, a lower part in the vertical direction of the second straight part (for example, the second straight part 155*c*) is tilted downwardly in the extending direction or the direction in which the second straight part extends toward the retracted position.

Consequently, as described in the above-described example with in FIG. 18, when compared with a configuration in which the upper part in the vertical direction of the second straight part is tilted upwardly in the direction in which the second straight part extends toward the retracted position, the retracted position of the latent image forming device (for example, the exposure device 60) can be disposed at a lower position. As a result, the upper space of the second straight part can be reduced and, as a result, a reduction in size of the image forming apparatus (for example, the image forming apparatus 1) can be achieved.

Aspect 6.

In any of Aspects 3 through 6, the first guide (for example, the exposure device guide slot 105*b* on the one end side) and the second guide (for example, the exposure device guide slot 105*b* on the opposed end side) are made such that the width of the second straight part (for example, the second straight part 155*c*) on the side of the retracted position is gradually reduced. In other words, the amount of play in the second straight part of each of the first guide and the second guide with respect to a corresponding one of the first projection and the second projection is gradually reduced toward the retracted position.

Consequently, as illustrated in the above-described example with FIG. 19, when the latent image forming device (for example, the exposure device 60) comes to the retracted position, movement of the projection (for example, the support projection 62) in the width direction of the first guide and/or the second guide is regulated by the first guide and/or the second guide. As a result, the altitude of the latent image forming device at the retracted position can remain stable.

Aspect 7.

In any one of Aspects 1 through 6, the moving unit comprises a first moving unit (for example, the retracting unit 100*a* on the one end side) to move the one end side of the latent image forming device between the image forming position and the retracted position and a second moving unit (for example, the retracting unit 100*b* on the opposed end side) to move the opposed end side of the latent image forming device between the image forming position and the retracted position.

Consequently, as described in the examples above, deviation of time in movements of both ends of the latent image forming device can be prevented when compared with a case in which a single moving unit is disposed at either of the one end side and the opposed end side of the latent image forming device.

Aspect 8.

An image forming apparatus (for example, the image forming apparatus 1) includes a latent image bearer (for example, the photoconductor drum 3) to form a latent image on a surface of the latent image bearer, a latent image forming device (for example, the exposure device 60), and the retractor (for example, the retracting device 20) according to one of Aspects 1 through 7 to move the latent image forming device (for example, the exposure device 60) between the image forming position at which the electrostatic latent image is formed on the surface of the latent image bearer (for example, the photoconductor drum 3) and the retracted position at which the latent image forming device stays away from the latent image forming device.

Consequently, the latent image forming device such as the exposure device 60 can be moved to the retracted position smoothly.

Aspect 9.

In Aspect 8, the latent image forming device (for example, the exposure device 60) includes a writing unit including multiple light emitters (for example, the multiple light emitting elements) spaced apart from each other in an axial direction of the latent image bearer (for example, the photoconductor drum 3). The multiple light emitters includes either one of light emitting diodes and organic electroluminescence elements.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A retractor comprising:

a moving unit to move a latent image forming device that forms a latent image on a surface of a latent image bearer between an image forming position at which the latent image forming device forms the latent image on the surface of the latent image bearer and a retracted position at which the latent image forming device stays away from the latent image forming device;

a first guide into which a first projection provided on one end side of the latent image forming device in a longitudinal direction of the latent image forming device is fitted in different ranges and changing an attitude of the one end side of the latent image forming device while guiding the first projection; and a second guide into which a second projection provided on an opposed end side of the latent image forming device in the longitudinal direction of the latent image forming device is fitted in different ranges and changing the altitude of the opposed end side of the latent image forming device while guiding the second projection, the different ranges of each of the first guide and the second guide including a first range where the attitude of each of the one end side and the opposed end side of the latent image forming device is changed and a second range where a corresponding one of the first projection and the second projection is located when the latent image forming device is at the image forming position, an amount of play in at least a part of the first range with respect to the corresponding one of the first projection and the second projection being greater than an amount of play in the second range.

2. The retractor according to claim 1, wherein each of the first guide and the second guide includes a first straight part extending in a direction separating from the surface of the latent image bearer;

a second straight part extending in a direction different from the first straight part; and a curved part connecting the first straight part and the second straight part, wherein an amount of play in at least one of the curved part. one side of the first straight part to the curved part, and one side of the second straight part to the curved part with respect to a corresponding one of the first projection and the second projection is greater than an amount of play in each of the first guide and the second guide with respect to a position of a corresponding one of the first projection and the second projection where the corresponding one of the first projection and the second projection is disposed when the latent image forming device is located at the image forming position.

3. The retractor according to claim 2, wherein the amount of play in the second straight part of each of the first guide and the second guide with respect to a corresponding one of the first projection and the second projection is gradually increased from the one side of the second straight part to the curved part toward the retracted position.

4. The retractor according to claim 3, wherein an upper part in a vertical direction of the second straight part is tilted upwardly in a direction in which the second straight part extends toward the retracted position.

5. The retractor according to claim 3, wherein a lower part in a vertical direction of the second straight part is tilted downwardly in a direction in which the second straight part extends toward the retracted position.

6. The retractor according to claim 3, wherein the amount of play in the second straight part of each of the first guide and the second guide with respect to a corresponding one of the first projection and the second projection is gradually reduced toward the retracted position.

7. The retractor according to claim 1, wherein the moving unit comprises a first moving unit to move the one end side of the latent image forming device between the image forming position and the retracted position; and a second moving unit to move the opposed end side of the latent image forming device between the image forming position and the retracted position.

8. An image forming apparatus comprising:

a latent image bearer;

a latent image forming device to form a latent image on a surface of the latent image bearer; and the retractor according to claim 1.

9. The image forming apparatus according to claim 8, wherein the latent image forming device includes a writing unit including multiple light emitters spaced apart from each other in an axial direction of the latent image bearer, wherein the multiple light emitters includes either one of a light emitting diode and an organic electroluminescence element.

* * * * *